US010408425B2

(12) United States Patent
Kim et al.

(10) Patent No.: US 10,408,425 B2
(45) Date of Patent: Sep. 10, 2019

(54) LIGHTING DEVICE WITH SOCKET CONNECTOR POSITIONING LIGHT SOURCE APART FROM HOUSING

(71) Applicant: LG Innotek Co., Ltd., Seoul (KR)

(72) Inventors: Jin Wook Kim, Seoul (KR); Ji Hwan Jeon, Seoul (KR); Sang Jun Hong, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 30 days.

(21) Appl. No.: 15/644,180

(22) Filed: Jul. 7, 2017

(65) Prior Publication Data

US 2017/0307173 A1 Oct. 26, 2017

Related U.S. Application Data

(63) Continuation of application No. 14/237,647, filed as application No. PCT/KR2012/006679 on Aug. 22, 2012, now Pat. No. 9,732,922.

(51) Int. Cl.
*F21V 19/00* (2006.01)
*F21S 4/00* (2016.01)
(Continued)

(52) U.S. Cl.
CPC ..... *F21V 7/06* (2013.01); *F21S 8/026* (2013.01); *F21S 8/03* (2013.01); *F21S 8/043* (2013.01);
(Continued)

(58) Field of Classification Search
CPC . F21K 9/27; F21K 9/275; F21V 21/02; F21V 21/04; F21V 19/001; F21V 19/005;
(Continued)

(56) References Cited

U.S. PATENT DOCUMENTS 2,295,788 A * 9/1942 Hoeveler ..... F21S 8/04 174/50
2,408,783 A * 10/1946 Kloner ..... F21S 8/031 362/219
(Continued)

FOREIGN PATENT DOCUMENTS

EP 2 287 520 2/2011
JP 04-123778 4/1992
(Continued)

OTHER PUBLICATIONS

International Search Report dated Feb. 19, 2013 issued in Application No. PCT/KR2012/006679.
(Continued)

*Primary Examiner* — Ismael Negron
(74) *Attorney, Agent, or Firm* — KED & Associates, LLP

(57) ABSTRACT

A lighting device includes a housing; a socket with a first portion coupled to an inner surface of the housing and a second portion extending from the first portion and including a connector; a light source body having a light emitting module with a terminal received by and in electrical communication with the connector; and a reflector facing the light source body, the light source body supported by the socket at a position apart from the housing.

11 Claims, 24 Drawing Sheets

(51) Int. Cl.

| | |
|---|---|
| ***F21V 7/06*** | (2006.01) |
| ***F21S 8/02*** | (2006.01) |
| ***F21V 21/02*** | (2006.01) |
| ***F21V 23/02*** | (2006.01) |
| ***F21V 23/06*** | (2006.01) |
| ***F21S 8/04*** | (2006.01) |
| ***F21V 15/01*** | (2006.01) |
| ***F21S 8/00*** | (2006.01) |
| ***F21V 3/00*** | (2015.01) |
| ***F21V 17/12*** | (2006.01) |
| *F21Y 103/10* | (2016.01) |
| *F21Y 115/10* | (2016.01) |
| *F21Y 103/00* | (2016.01) |

(52) U.S. Cl.
CPC ..... *F21V 3/00* (2013.01); *F21V 15/01* (2013.01); *F21V 17/12* (2013.01); *F21V 19/008* (2013.01); *F21V 21/02* (2013.01); *F21V 23/023* (2013.01); *F21V 23/06* (2013.01); *F21Y 2103/00* (2013.01); *F21Y 2103/10* (2016.08); *F21Y 2115/10* (2016.08)

(58) Field of Classification Search
CPC ..... F21V 19/0025; F21S 8/026; F21S 8/03; F21S 8/04; F21S 8/02; H01R 13/717
USPC ..... 362/219, 217.13, 217.17
See application file for complete search history.

(56) References Cited

U.S. PATENT DOCUMENTS 3,138,418 A * 6/1964 Vermenlen ..... F21V 19/0085 174/158 R
3,168,987 A 2/1965 Heisler
3,176,260 A 3/1965 Pascucci
3,397,376 A 8/1968 Gombar
3,524,053 A * 8/1970 Johnson ..... F21V 19/008 439/242
4,130,860 A * 12/1978 Careglio ..... F21S 8/031 362/217.08
5,006,970 A * 4/1991 Mackiewicz ..... F21V 19/008 362/217.08
5,371,661 A * 12/1994 Simpson ..... F21V 19/008 362/219
6,210,019 B1 * 4/2001 Weathers ..... F21S 8/04 362/220
6,936,968 B2 * 8/2005 Cross ..... H05B 33/0803 313/21
7,307,391 B2 12/2007 Shan
7,401,942 B1 * 7/2008 Verfuerth ..... F21S 8/06 362/217.05
7,674,016 B2 * 3/2010 Zhang ..... F21V 29/004 362/294
7,872,278 B2 1/2011 Stoyan
7,887,226 B2 * 2/2011 Huang ..... F21K 9/27 362/225
7,918,580 B2 * 4/2011 Liu ..... F21K 9/00 362/217.08
7,976,196 B2 * 7/2011 Ivey ..... F21K 9/27 362/218
8,220,956 B2 * 7/2012 Lai ..... F21V 19/0045 362/217.01
8,360,599 B2 * 1/2013 Ivey ..... F21V 23/06 362/218
8,454,193 B2 6/2013 Simon et al.
9,057,493 B2 * 6/2015 Simon ..... F21V 7/0008
2006/0232959 A1 10/2006 Hutchison et al.
2007/0070631 A1 * 3/2007 Huang ..... H01R 33/942 362/222
2009/0168439 A1 7/2009 Chiang
2009/0206755 A1 * 8/2009 Tsai ..... F21V 3/061 313/635
2010/0214779 A1 * 8/2010 Kao ..... F21K 9/27 362/249.02
2010/0253226 A1 * 10/2010 Oki ..... F21V 3/00 315/113
2011/0019421 A1 * 1/2011 Lai ..... F21K 9/27 362/249.06
2011/0292647 A1 * 12/2011 Chang ..... F21V 3/04 362/218
2012/0212950 A1 8/2012 Wei

FOREIGN PATENT DOCUMENTS

| | | |
|---|---|---|
| JP | 2004-311371 | 11/2004 |
| JP | 2008-251482 | 10/2008 |
| JP | 3147577 | 12/2008 |
| JP | 2010-015700 | 1/2010 |
| JP | 2010-170742 | 8/2010 |
| JP | 2010-272377 | 12/2010 |
| JP | 3168979 | 7/2011 |
| JP | 2011-233358 | 11/2011 |
| KR | 10-0923982 | 10/2009 |
| KR | 20-0446427 | 10/2009 |
| KR | 10-2011-0049313 | 5/2011 |

OTHER PUBLICATIONS

Supplementary Partial European Search Report dated Feb. 10, 2015 issued in Application No. 12825064.4.
Japanese Office Action dated May 24, 2016 issued in Application No. 2014-527069.
U.S. Office Action dated Jul. 22, 2016 issued in U.S. Appl. No. 14/237,647.
U.S. Final Office Action dated Oct. 20, 2016 issued in U.S. Appl. No. 14/237,647.
Japanese Office Action dated Dec. 6, 2016 issued in Application No. 2014-527069.
U.S. Notice of Allowance dated Apr. 10, 2017 issued in U.S. Appl. No. 14/237,647.

* cited by examiner

[Fig. 1]
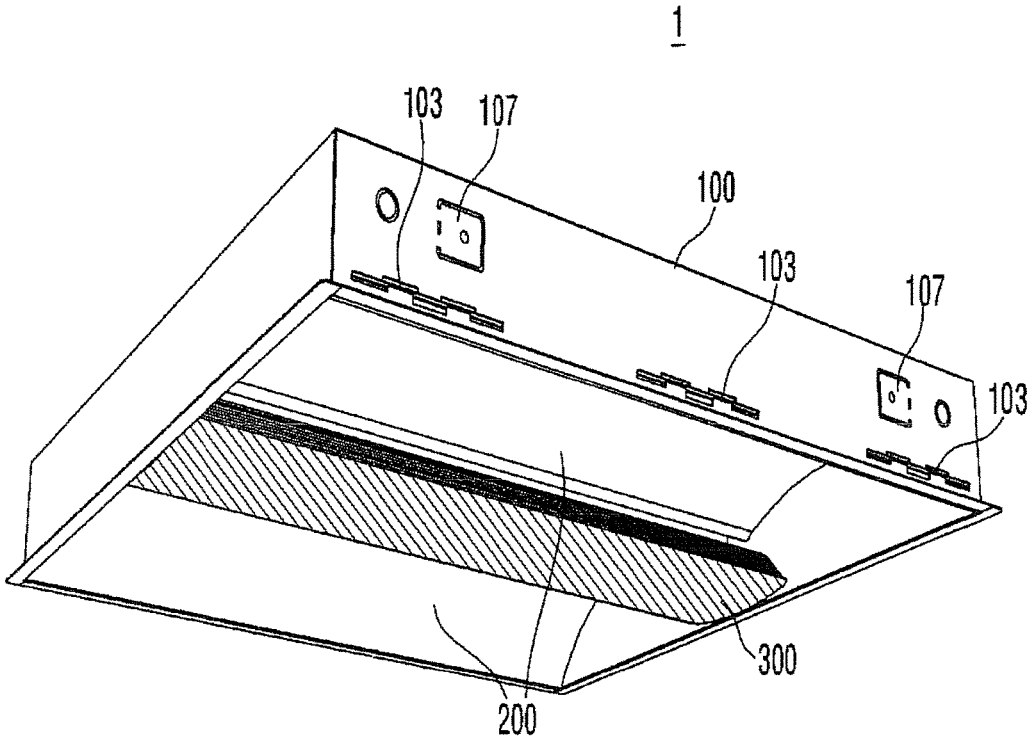

[Fig. 2]
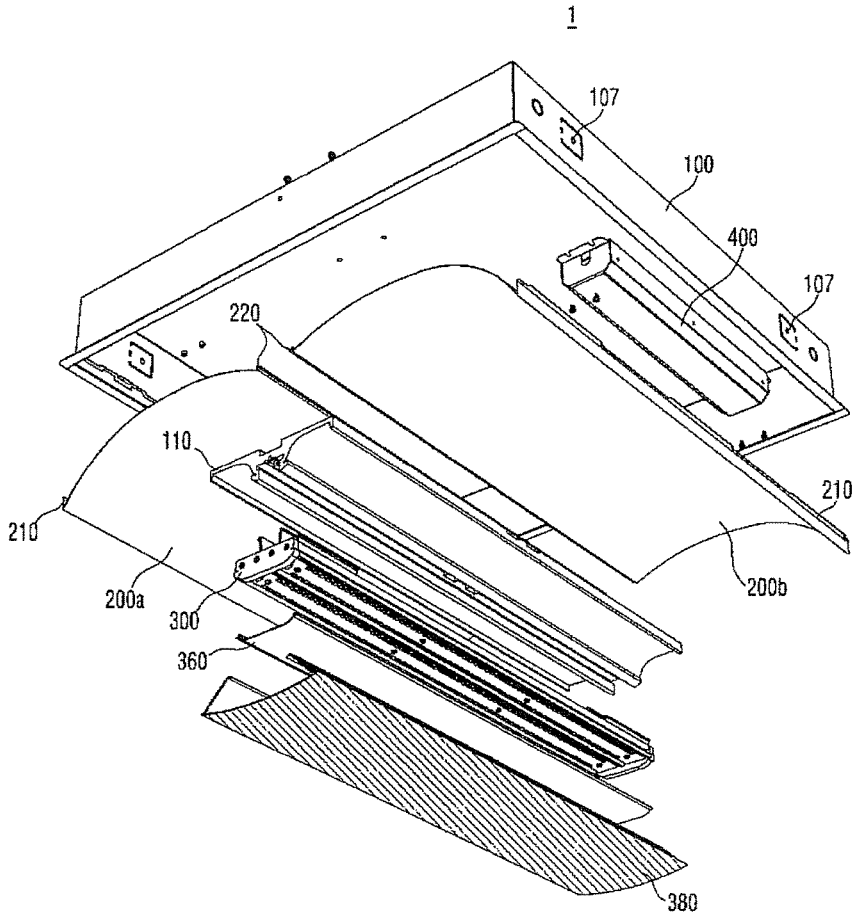
[Fig. 3]
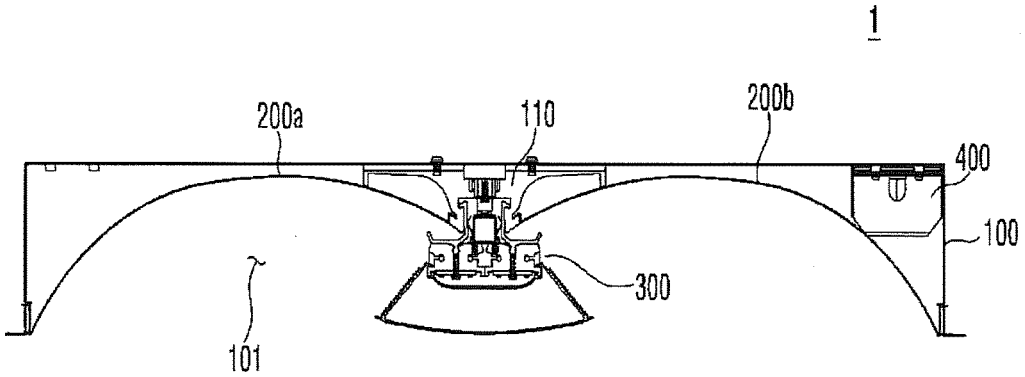

[Fig. 4a]
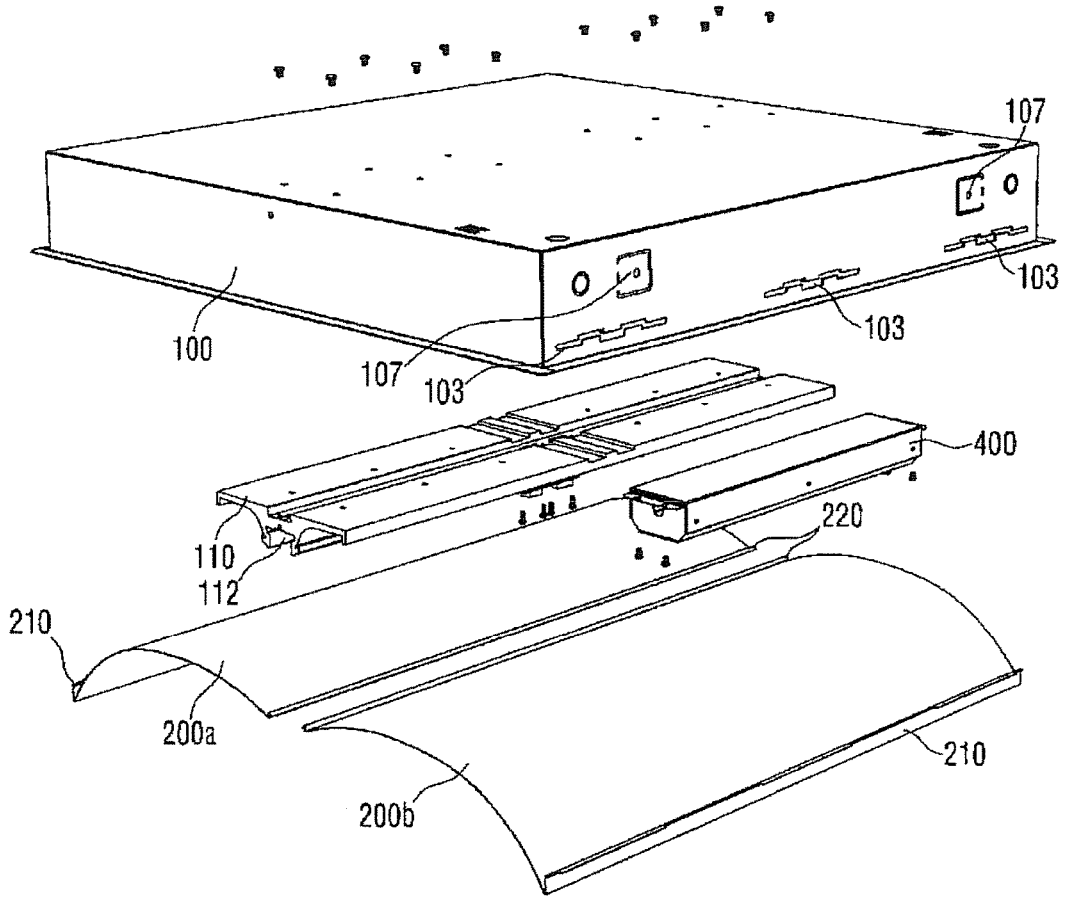

[Fig. 4b]
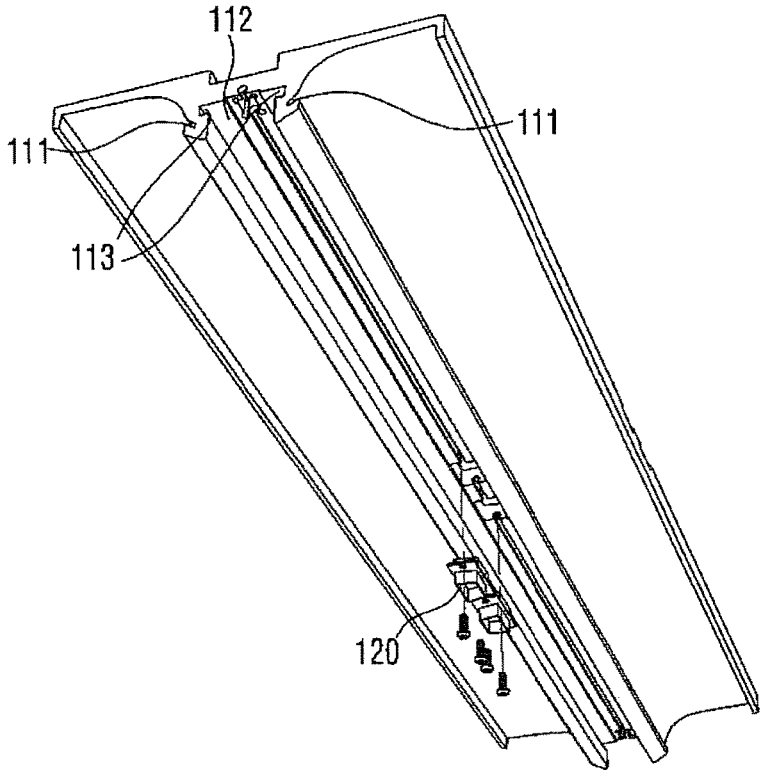
[Fig. 4c]
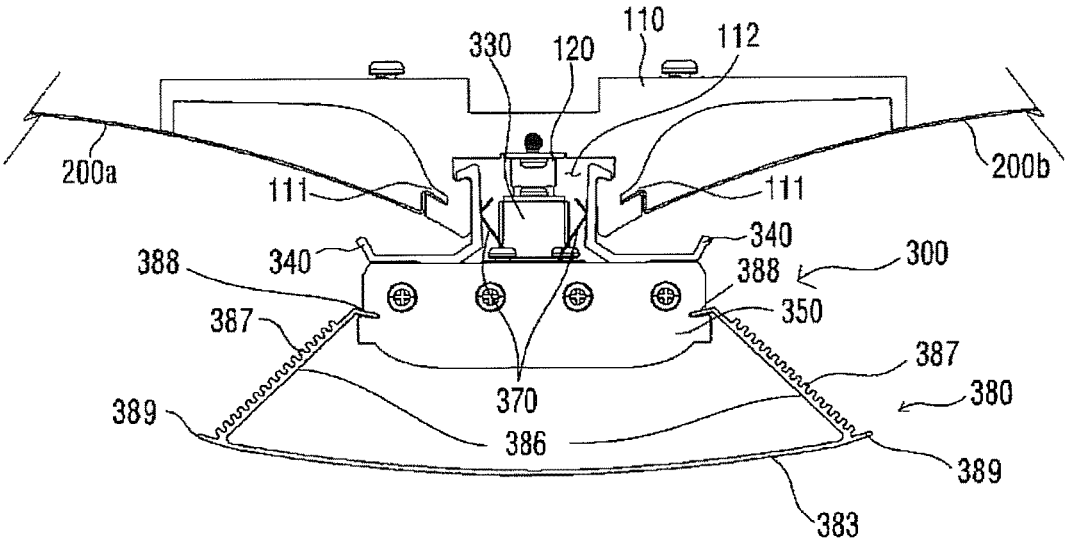

[Fig. 5]
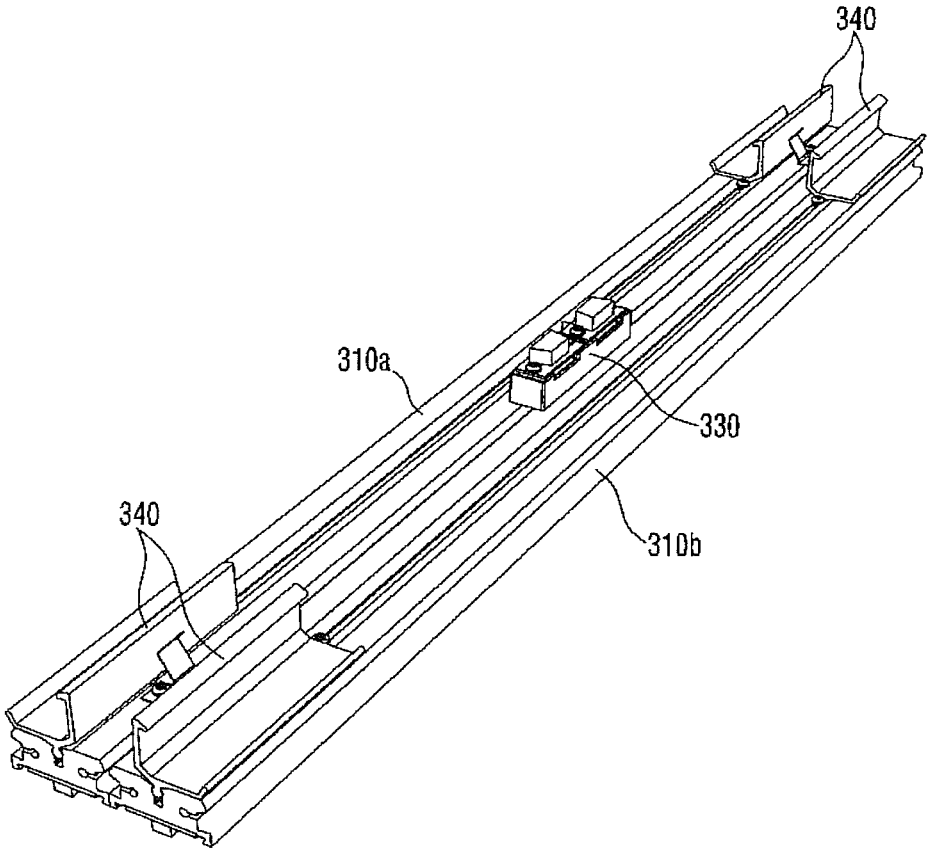

[Fig. 6]
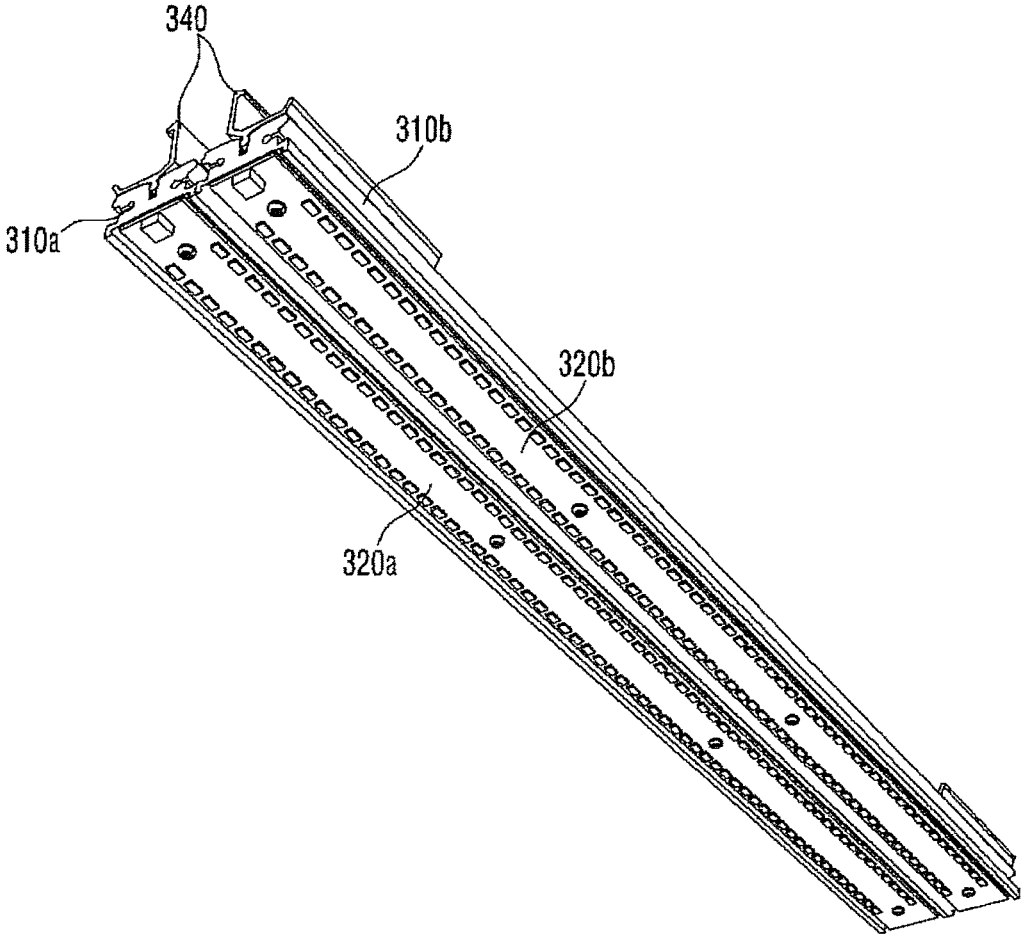

[Fig. 7]
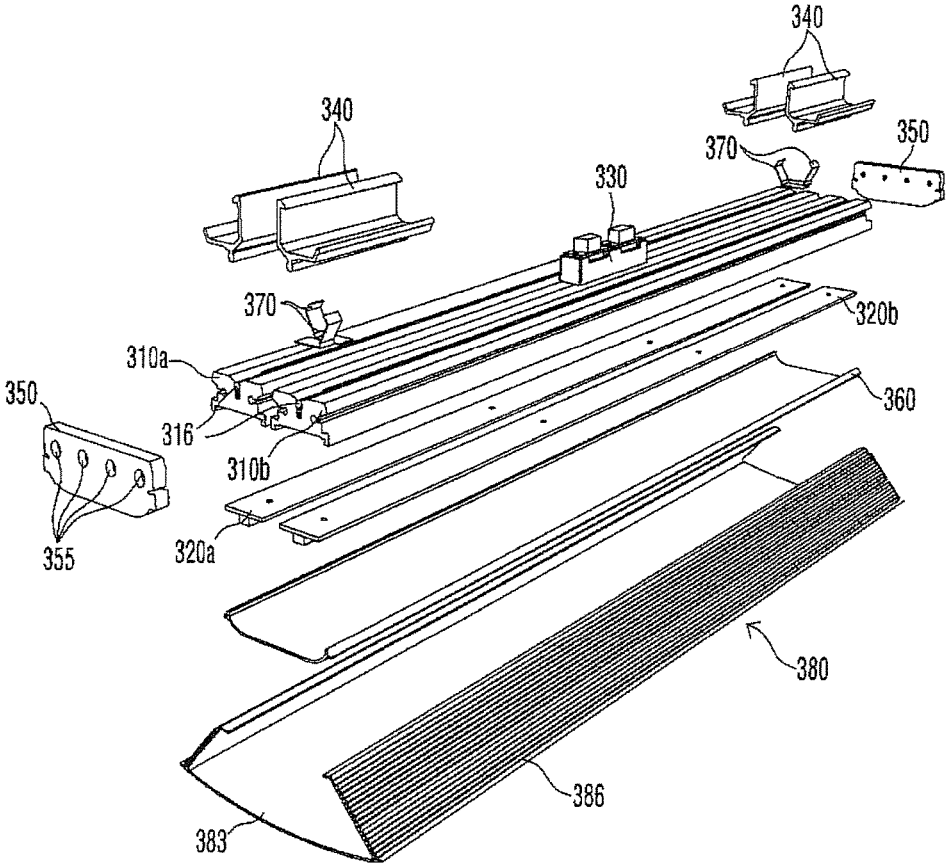

[Fig. 8a]
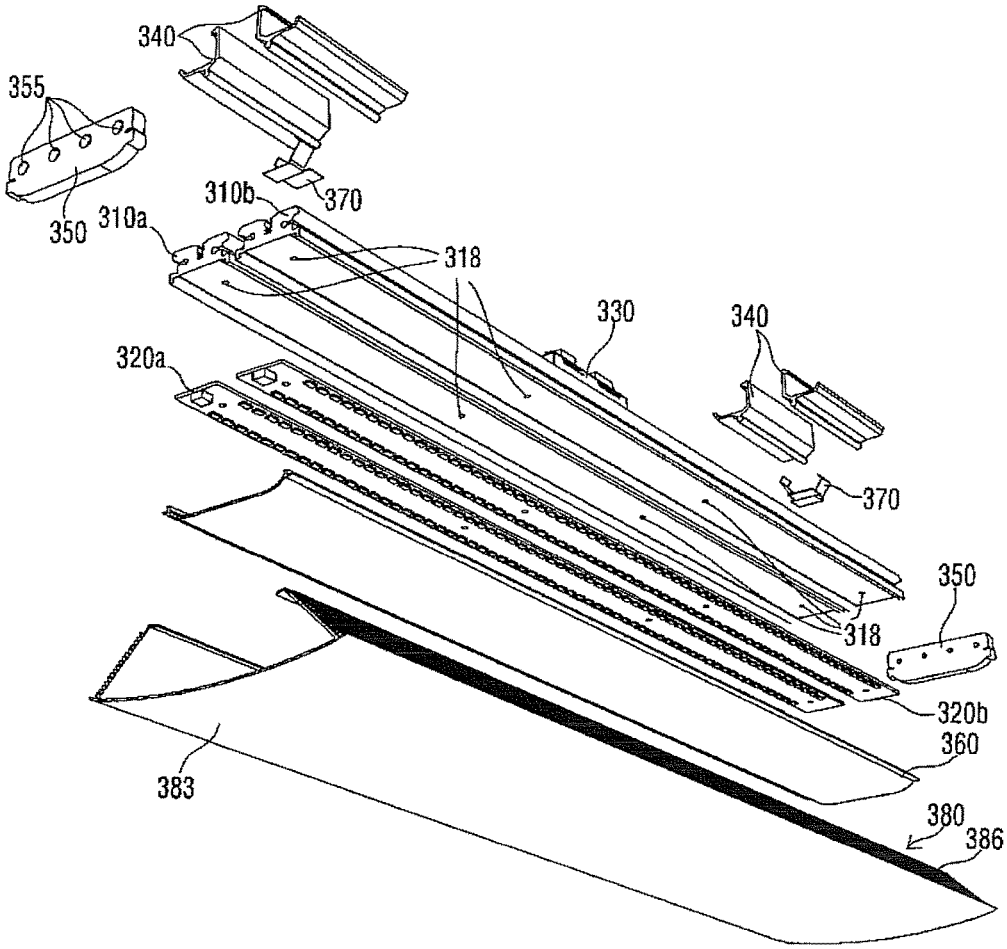
[Fig. 8b]
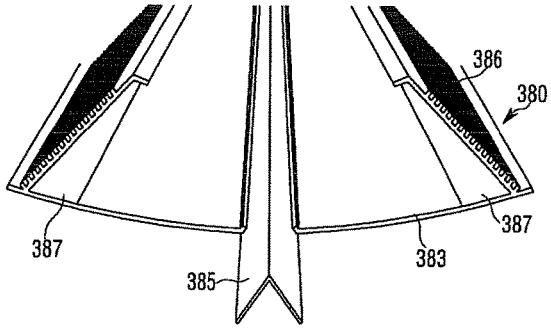

[Fig. 8c]
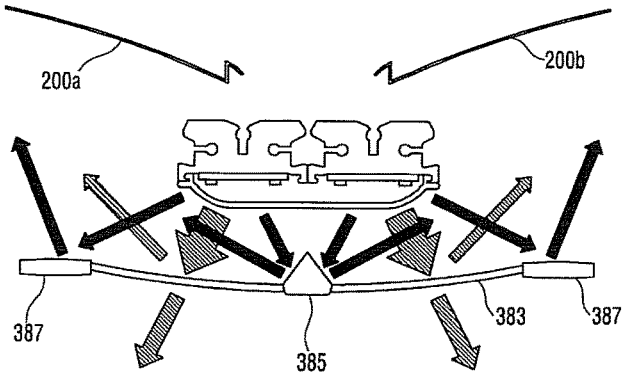
[Fig. 9a]
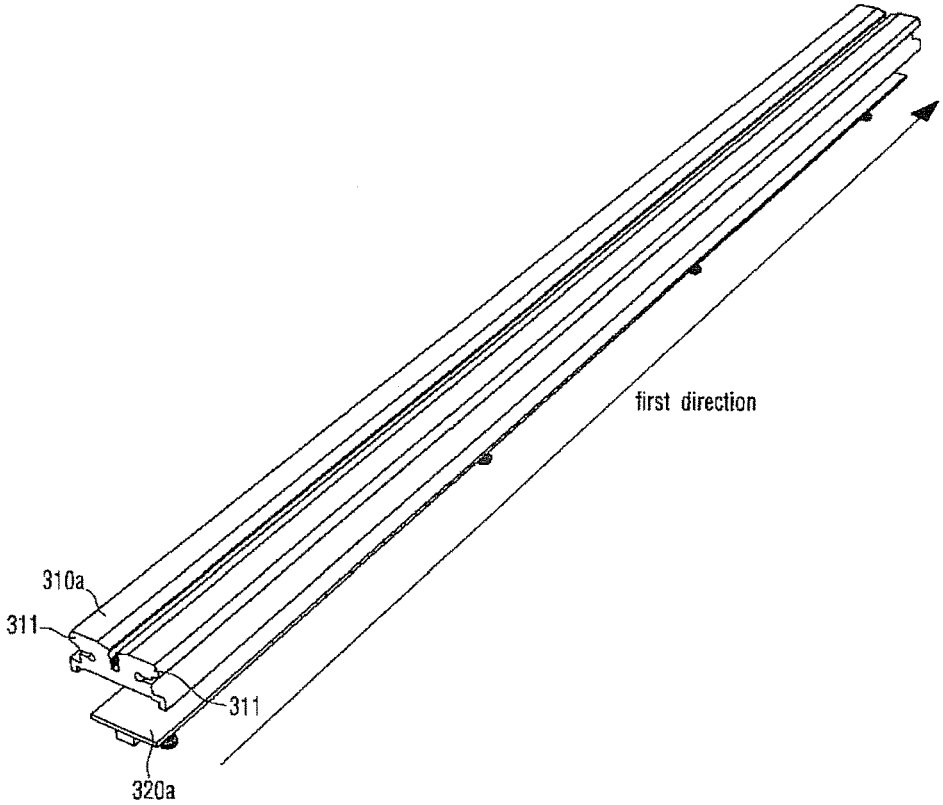
[Fig. 9b]
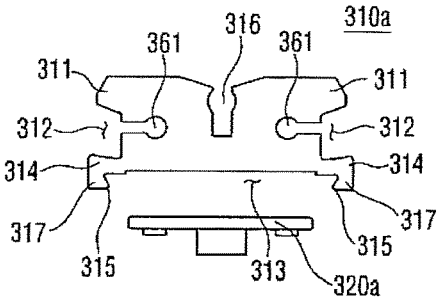

[Fig. 9c]
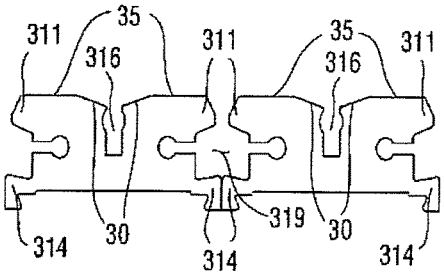
[Fig. 10]
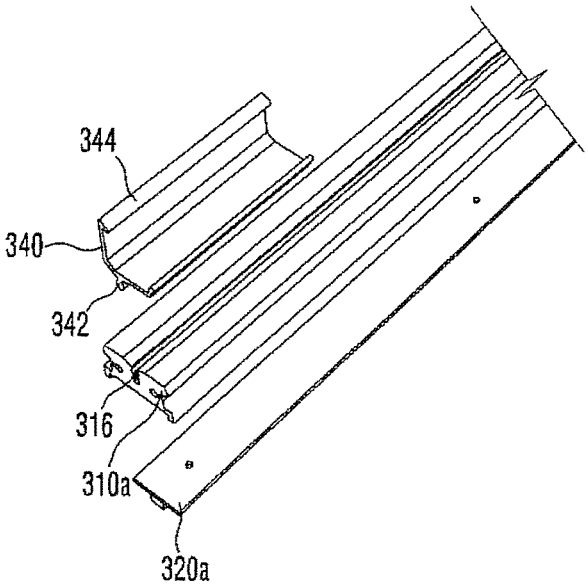
[Fig. 11]
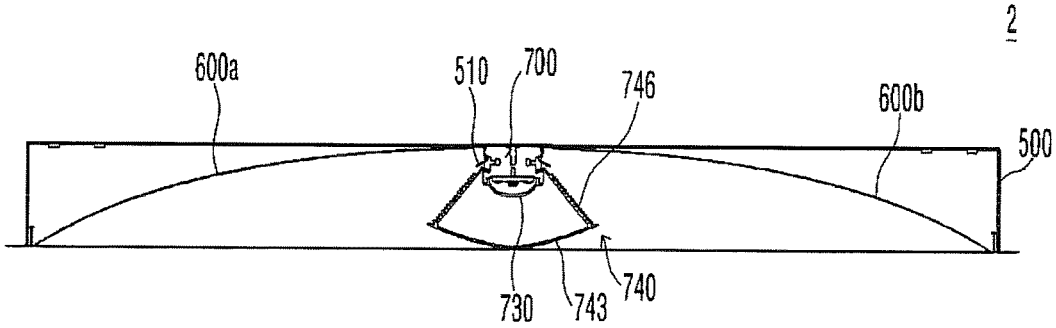

[Fig. 12]
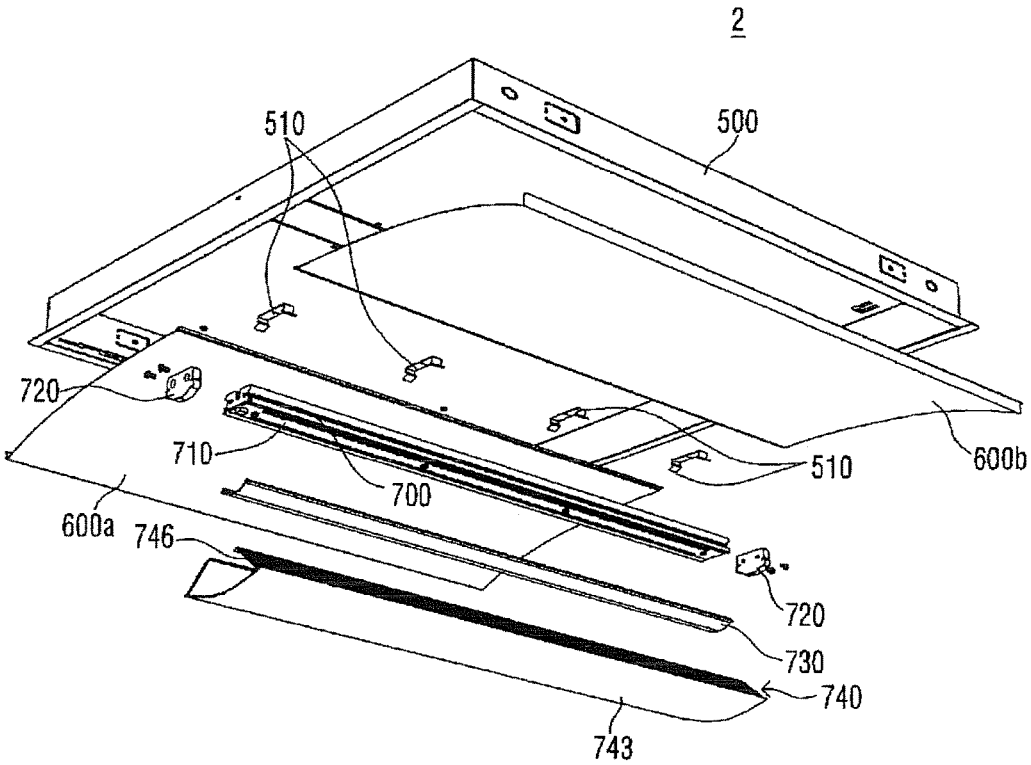
[Fig. 13]
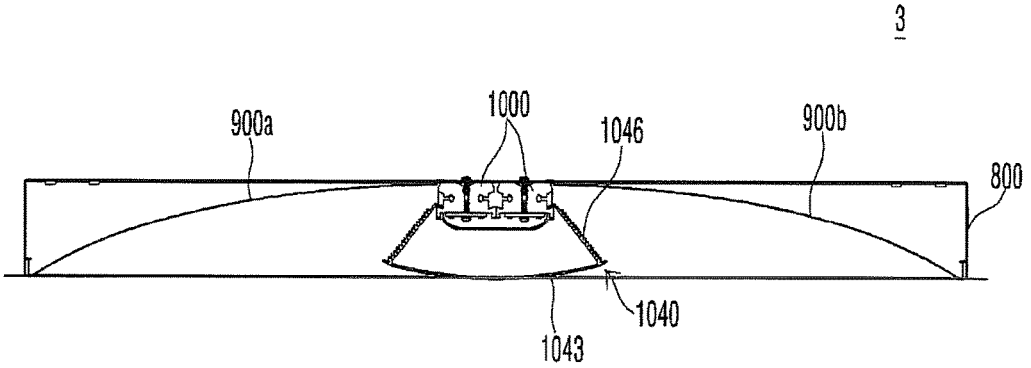

[Fig. 14]
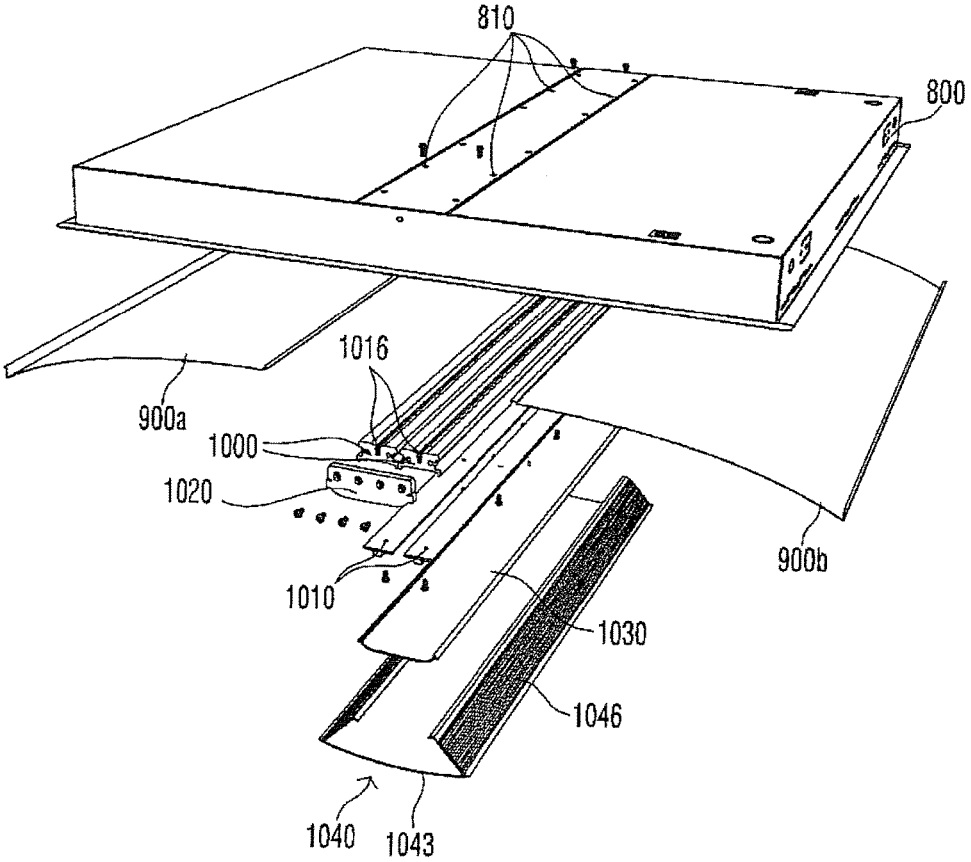
[Fig. 15]
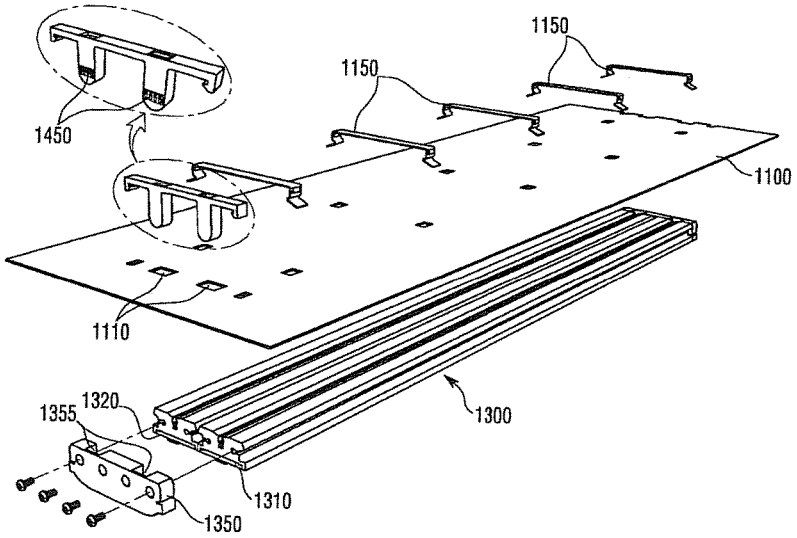

[Fig. 16]
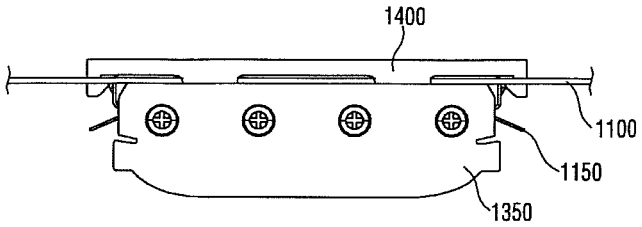
[Fig. 17]
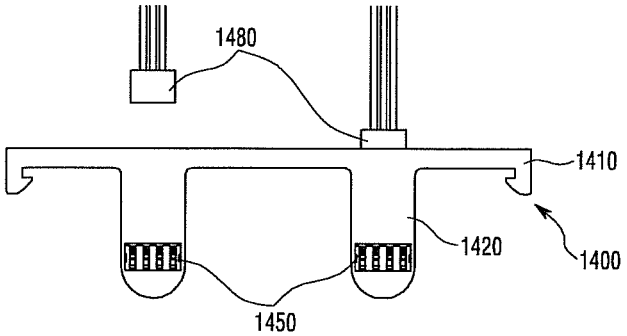
[Fig. 18]
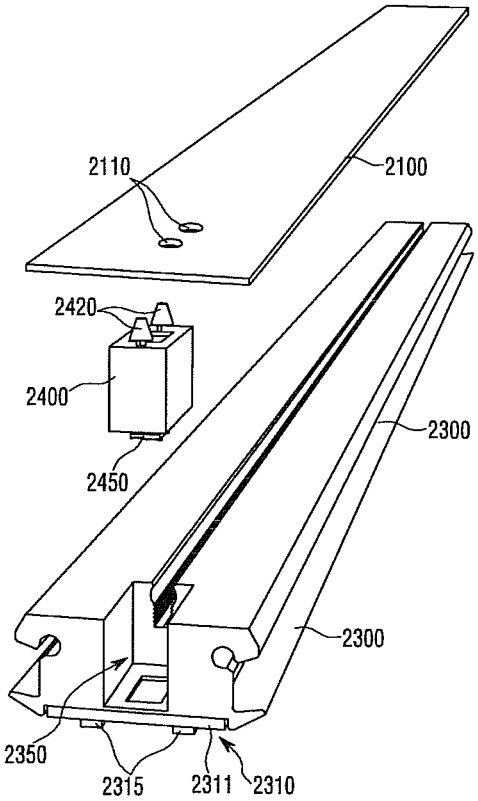

[Fig. 19]
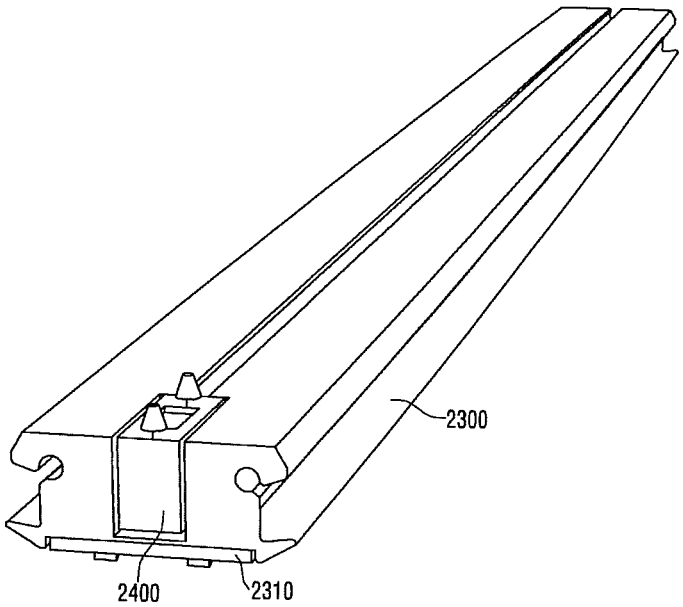
[Fig. 20]
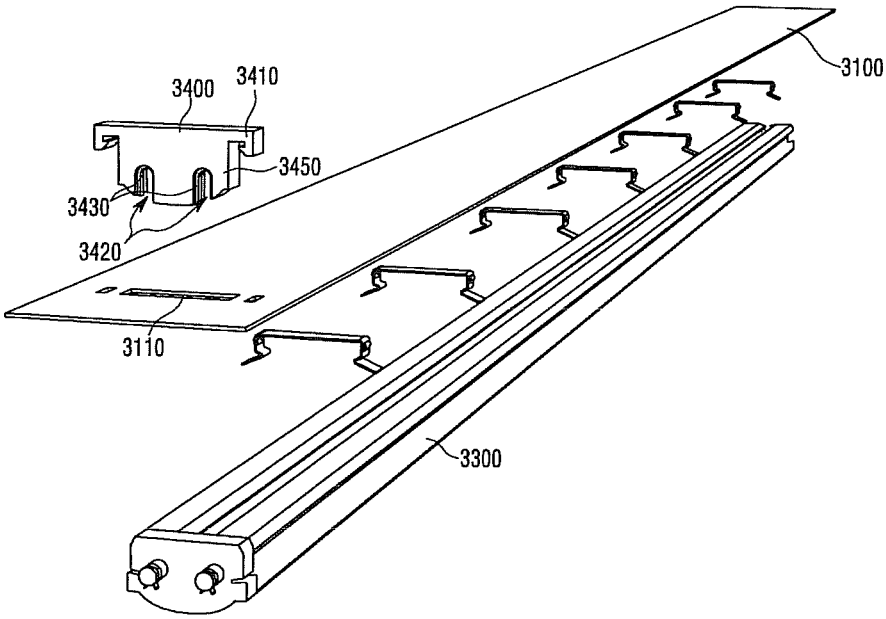

[Fig. 21]
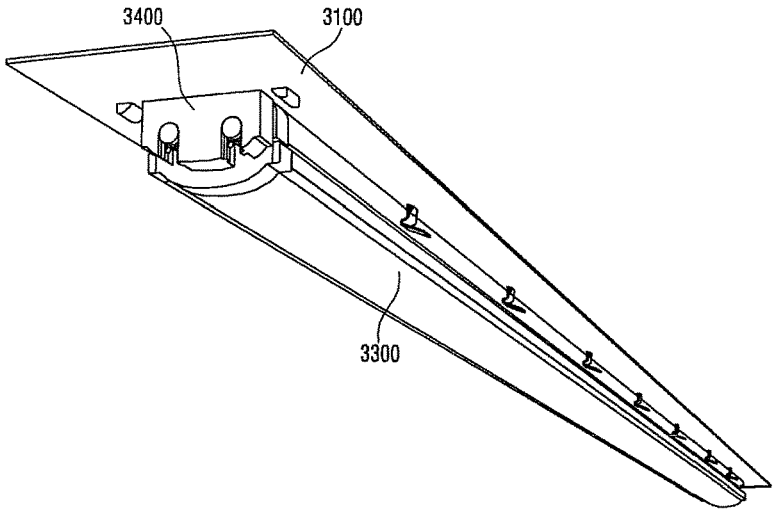
[Fig. 22a]
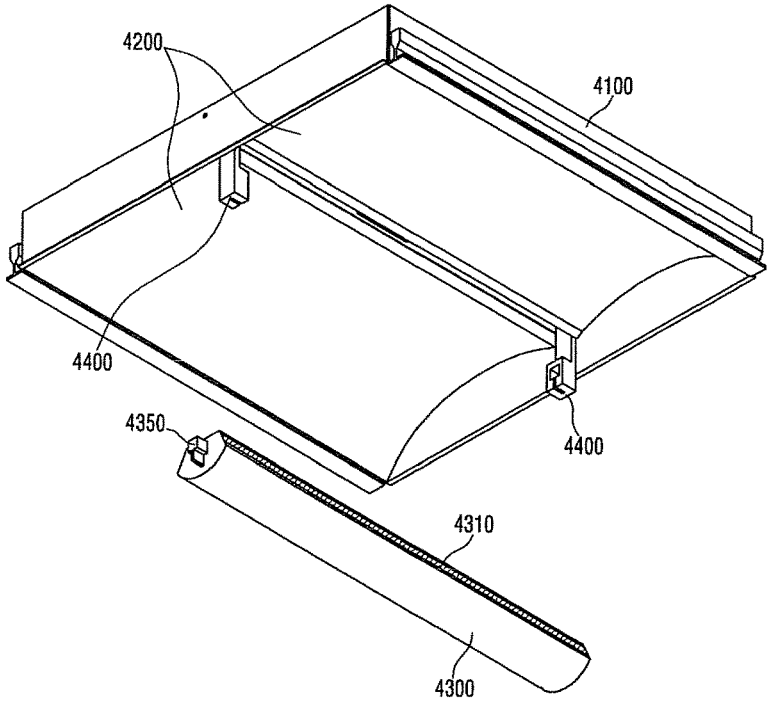
[Fig. 22b]
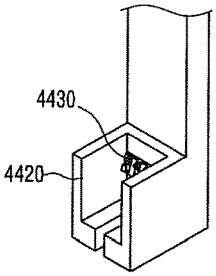

[Fig. 22c]
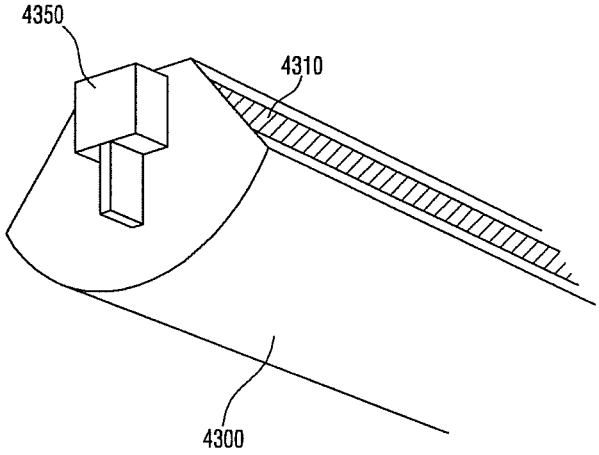
[Fig. 23]
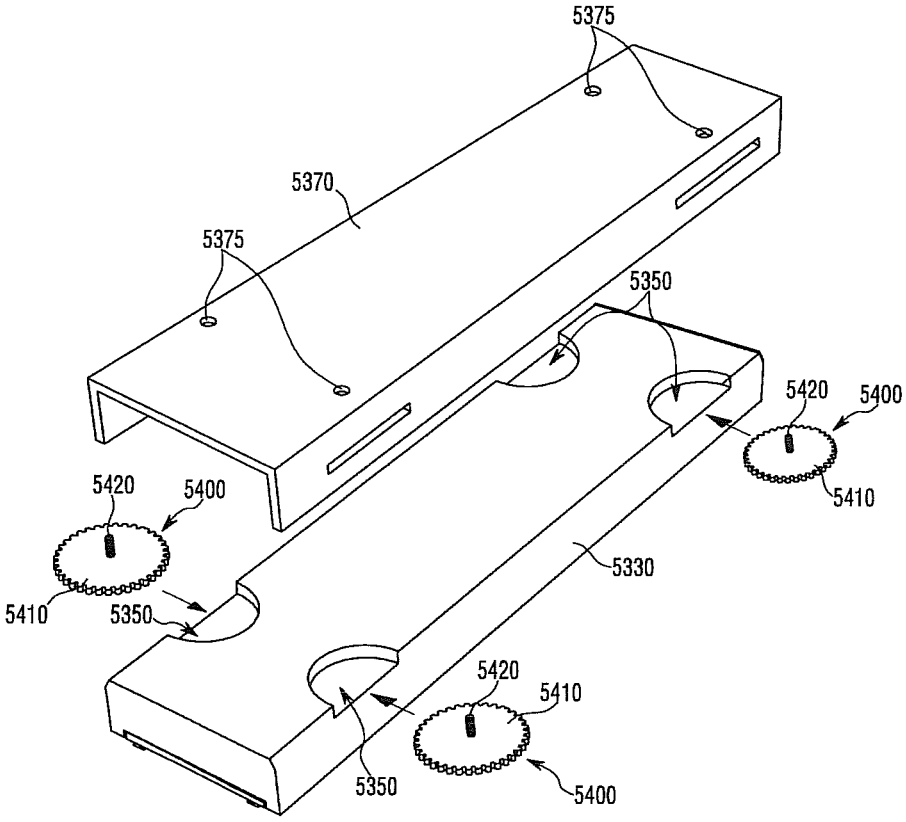

[Fig. 24]
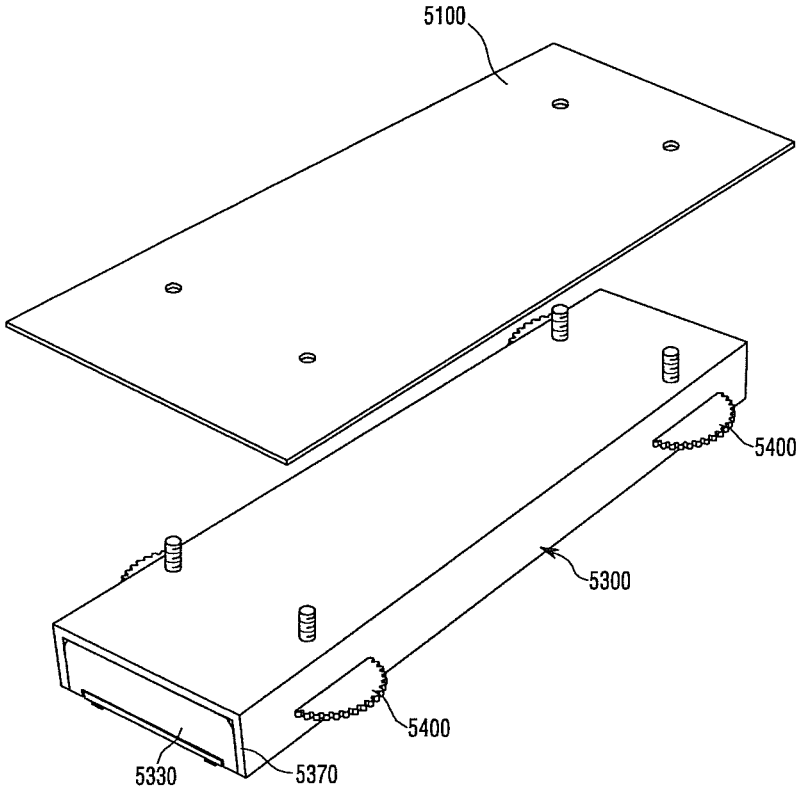

[Fig. 25]
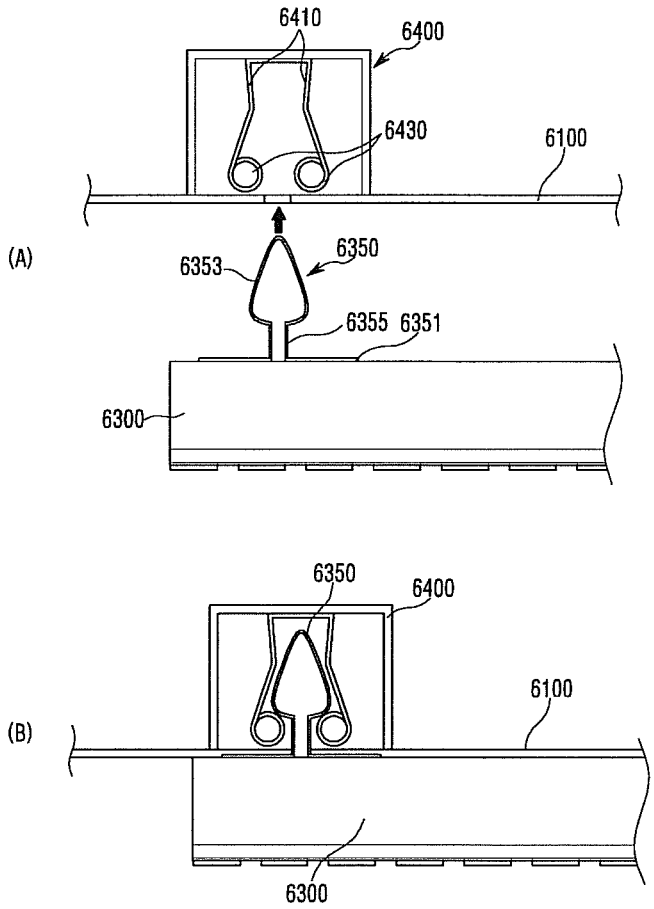
[Fig. 26]
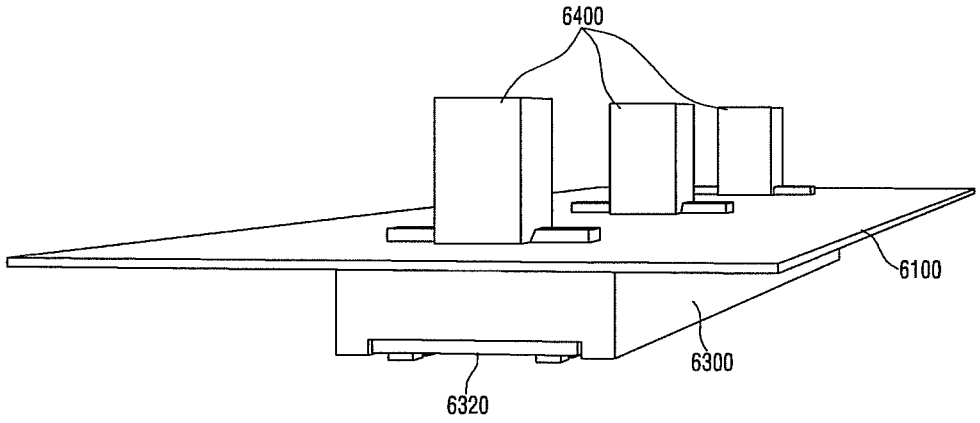

[Fig. 27]
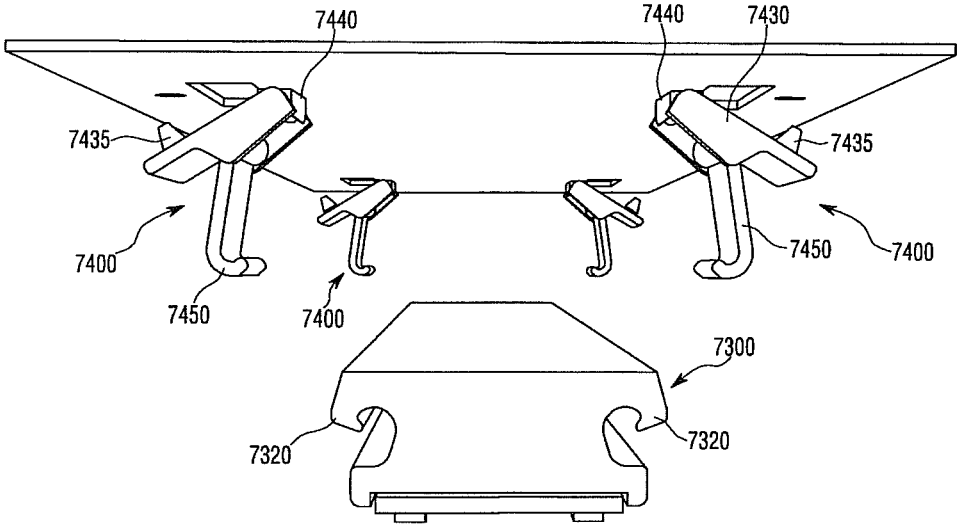
[Fig. 28]
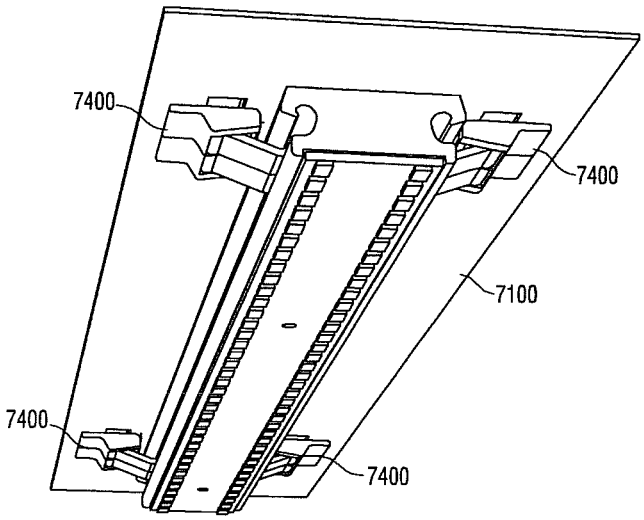

[Fig. 29a]
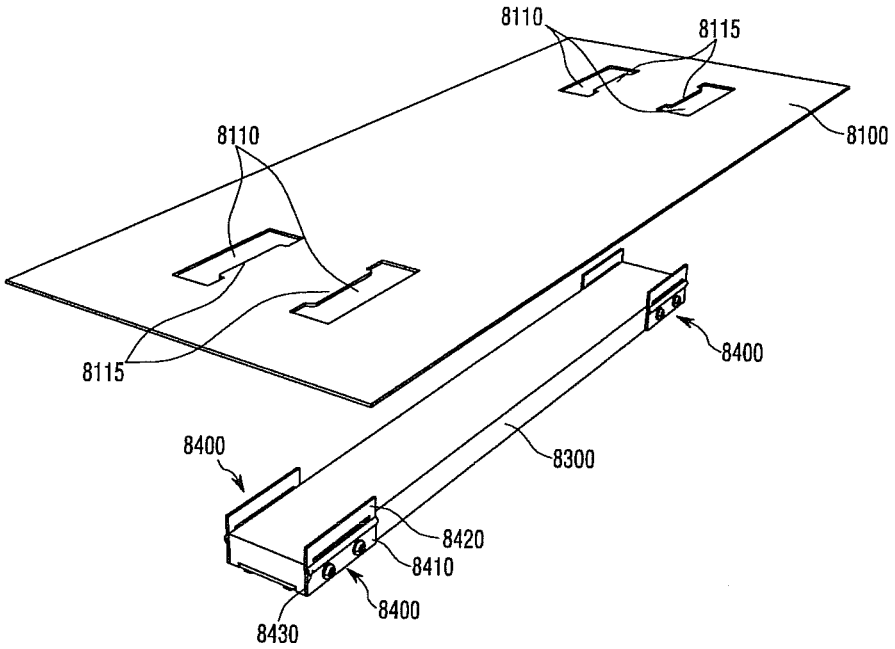
[Fig. 29b]
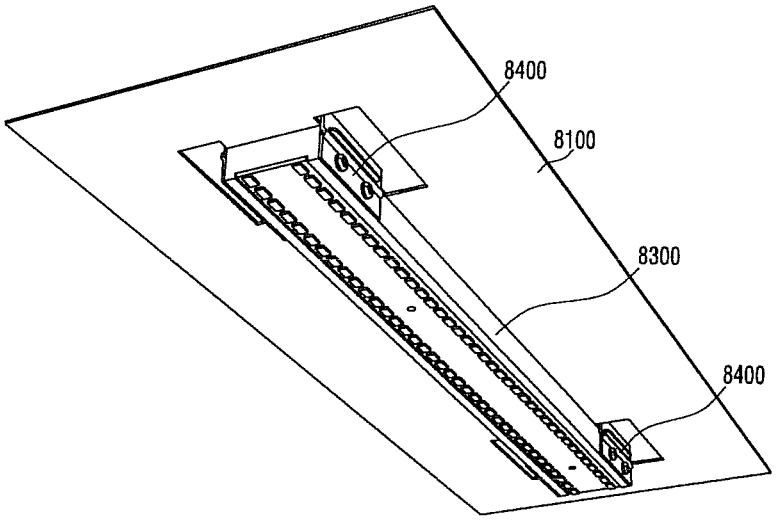
[Fig. 30]
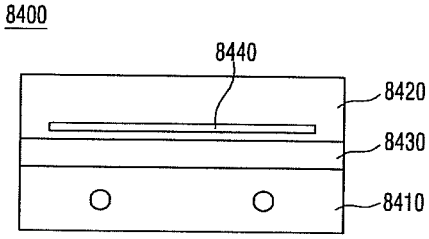

[Fig. 31]
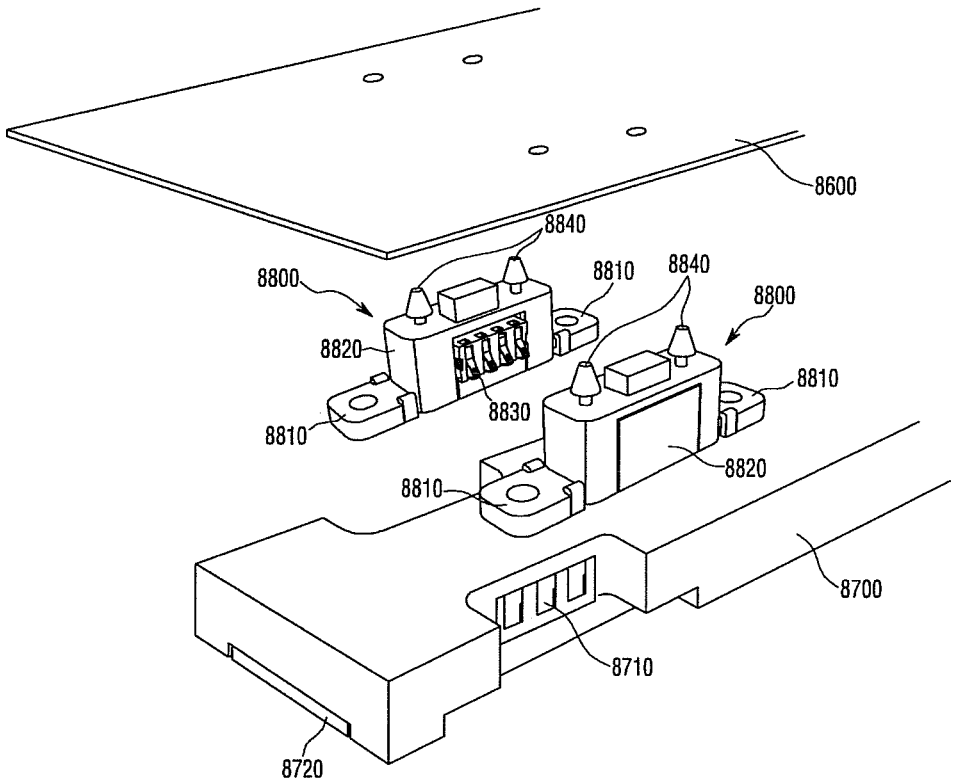
[Fig. 32]
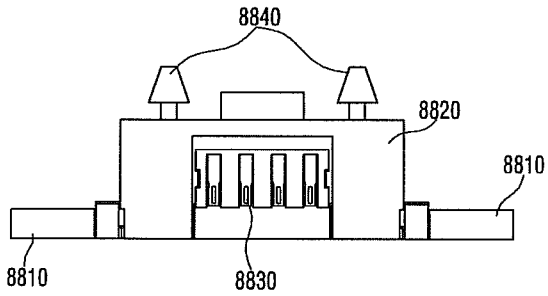

[Fig. 33]
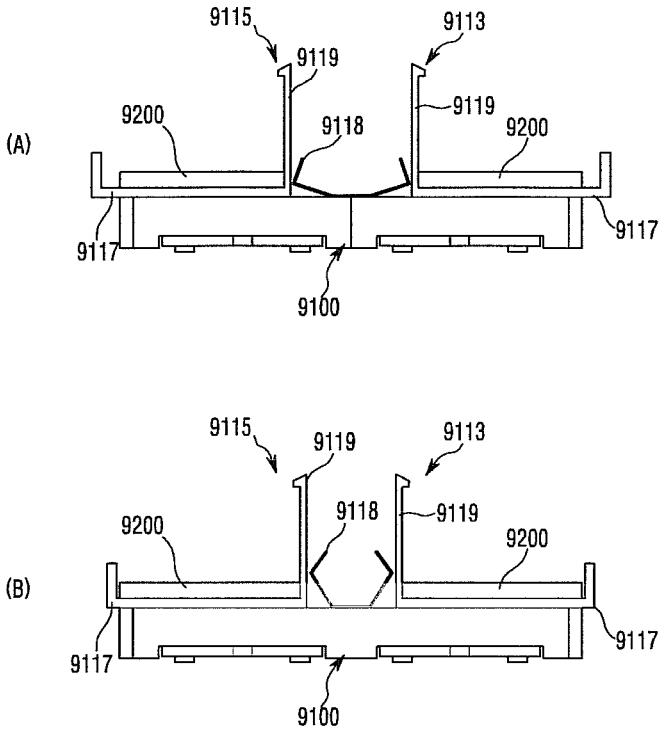
[Fig. 34]
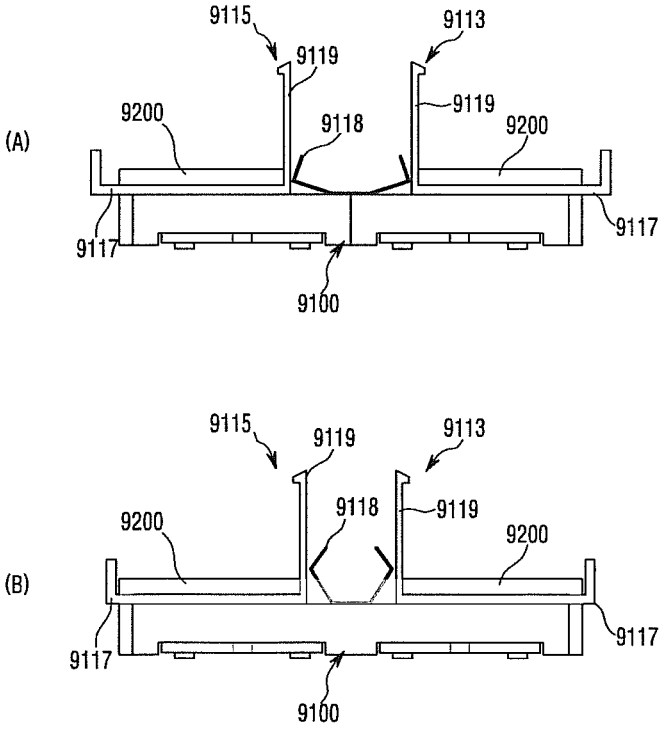

[Fig. 35]
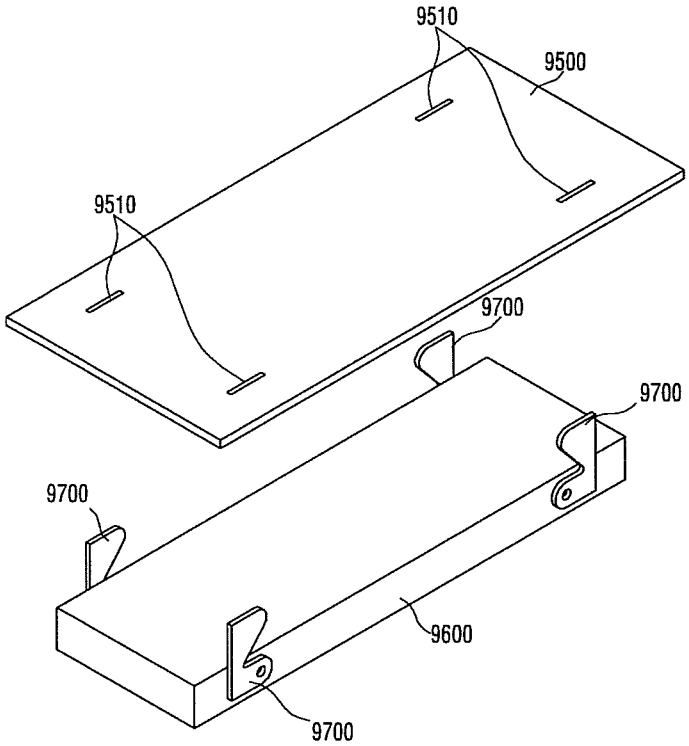
[Fig. 36]
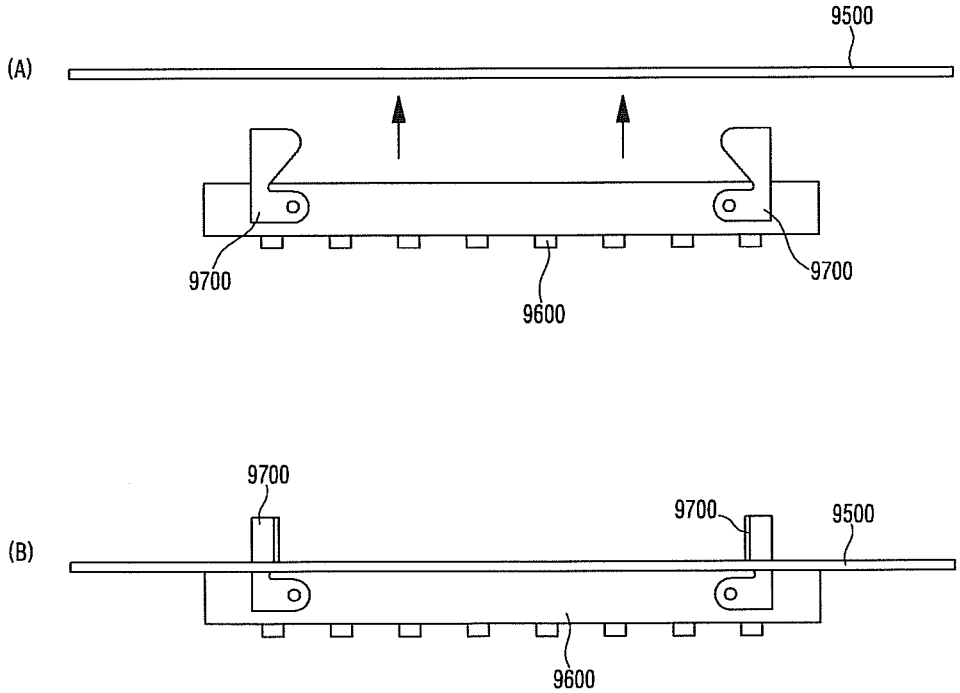

[Fig. 37]
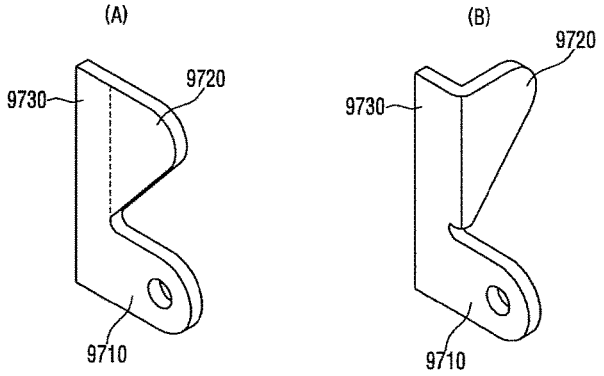
[Fig. 38]
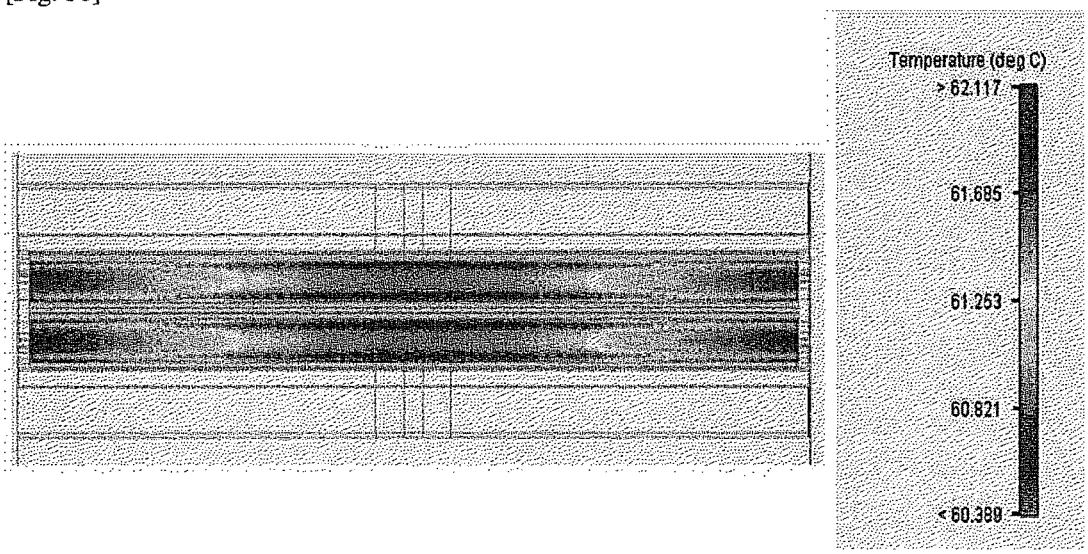
[Fig. 39]
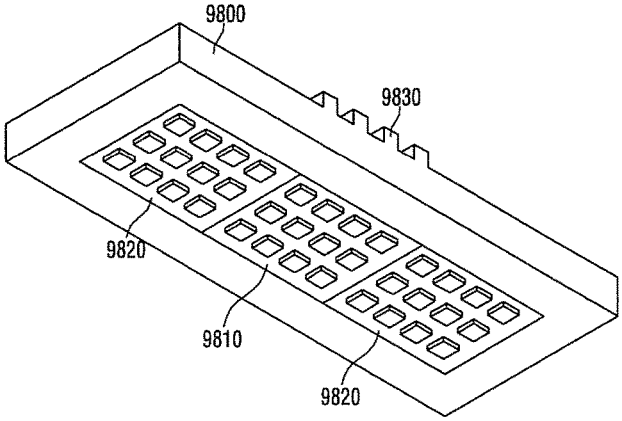

LIGHTING DEVICE WITH SOCKET CONNECTOR POSITIONING LIGHT SOURCE APART FROM HOUSING

CROSS-REFERENCE TO RELATED APPLICATIONS

This application is a Continuation application of prior U.S. patent application Ser. No. 14/237,647 filed Feb. 7, 2014, which is a U.S. National Stage application under 35 U.S.C. § 371 of PCT Application No. PCT/KR2012/006679, filed Aug. 22, 2012, which claims priority under 35 U.S.C. § 119 to Korean Application No. 10-2011-0083217 filed on Aug. 22, 2011, whose entire disclosures are hereby incorporated by reference.

BACKGROUND

1. Field

This embodiment relates to a lighting device.

2. Background

A light emitting diode (LED) is a semiconductor element for converting electric energy into light. As compared with existing light sources such as a fluorescent lamp and an incandescent electric lamp and so on, the LED has advantages of low power consumption, a semi-permanent span of life, a rapid response speed, safety and an environment-friendliness. For this reason, many researches are devoted to substitution of the existing light sources with the LED. The LED is now increasingly used as a light source for lighting devices, for example, various lamps used interiorly and exteriorly, a liquid crystal display device, an electric sign and a street lamp and the like. The above references are incorporated by reference herein where appropriate for appropriate teachings of additional or alternative details, features and/or technical background.

DISCLOSURE OF INVENTION

Technical Problem

The objective of the present invention is to provide a lighting device having a new structure.

The objective of the present invention is to provide a lighting device which is easy to replace and assemble.

The objective of the present invention is to provide a lighting device which is attachable to a conventional housing and has a lower manufacturing cost and weight.

The objective of the present invention is to provide a lighting device which provides indirect light as well as direct light.

Solution to Problem

One embodiment is a lighting device. The lighting device includes: a housing; a light source body which is disposed under the housing and includes a terminal; a light emitting module which is disposed in the light source body; and a socket which includes a connector electrically connected to the terminal and physically connects the housing with the light source body.

The housing has a through-hole. The socket includes a horizontal portion which is disposed on the top surface of the housing, and a vertical projection which is connected to the horizontal portion and passes through the through-hole of the housing and then is connected to the light source body. The connector is formed in the vertical projection of the socket.

A plurality of the light source bodies are provided. The lighting device includes an end cap which is coupled to one sides of the plurality of the light source bodies.

The end cap has an opening. The number of the openings corresponds to the number of the plurality of the light source bodies.

The socket passes through the housing and is connected to the opening, and then is electrically connected to the terminal.

The terminal of the light source body has a projecting shape. The vertical projection of the socket has a receiving recess in which the terminal is disposed. The connector is disposed in the receiving recess.

The lighting device further includes a clip which is disposed in the housing, projects downwardly from the housing and fixes the light source body to the housing.

The housing has a hole. The light source body has a recess having a shape corresponding to the socket. The terminal of the light source body is disposed within the recess. The socket includes a hook which is coupled to the housing.

The socket includes: a catching projection which is disposed in the light source body; and a connecting portion which is disposed perpendicular to the catching projection.

The lighting device further includes a clip which is disposed on the housing, projects inwardly from the housing and fixes the light source body to the housing.

The lighting device further includes a reflector disposed in the housing. The socket extends from a side of the housing and includes a receiving portion. The receiving portion has a shape corresponding to the shape of the terminal. The terminal is disposed in the receiving portion. The connector is disposed within the receiving portion.

The light emitting module includes: a first light emitting module which is disposed in the light source body; and a second light emitting module which is disposed adjacent to the first light emitting module. An optical efficiency of the first light emitting module is better than that of the second first light emitting module.

The lighting device further includes a heat radiation sheet between the first light emitting module and the light source body.

The light source body further includes a heat radiating structure. The heat radiating structure is disposed on the first light emitting module.

The light source body includes a first heat radiating structure and a second heat radiating structure. The first heat radiating structure is arranged on the first light emitting module. The second heat radiating structure is arranged on the second first light emitting module. An arrangement density of the first heat radiating structure is higher than that of the second heat radiating structure.

Another embodiment is a lighting device. The lighting device includes: a housing; a light source body disposed under the housing; a light emitting module disposed in the light source body; and a connecting means which physically connects the housing with the light source body.

The light source body includes a lower body and an upper body disposed on the lower body. The connecting means is a coupler. The coupler includes a horizontal portion and a vertical portion which has a screw shape and is disposed perpendicular to the center of the horizontal portion. The lower body has a horizontal recess in which the horizontal portion of the coupler is disposed. The upper body has a through-hole through which the vertical portion of the coupler passes. The vertical portion of the coupler is screw-coupled to housing, so that the light source body is coupled to the housing.

The vertical portion has a circular shape. A sawtooth shape is formed on the circumference of the horizontal portion.

A portion of the horizontal portion of the coupler projects outwardly from the light source body.

An insertion member is disposed on one side of the light source body. The connecting means is a fixing box. The fixing box is disposed on the housing and includes an elastic body and a support. The insertion member is inserted into the fixing box and contacts with the elastic body of the fixing box. The support supports the insertion member.

The insertion member includes a coupling portion which is coupled to the light source body, a contacting portion which is inserted into the fixing box, and a connection portion which connects the coupling portion with the contacting portion. A width of the contacting portion decreases with the approach to the upper portion thereof. A width of the connection portion is less than that of the lowest portion of the contacting portion.

The fixing box includes a pair of elastic bodies. The elastic bodies face each other and have an elastic force causing themselves to be closer to each other.

The support is disposed in the lower portion of the contacting portion and fixes the insertion member.

The light source body includes a catching projection formed on both sides thereof. The connecting means is a fastener. The fastener includes a rotating member including a first hinge and a second hinge, a fixing member coupled to the first hinge and the housing, and a settling member of which one end is coupled to the second hinge and of which the other end is coupled to the light source body. The fastener is disposed on both sides of the light source body.

The rotating member includes a hook which is coupled to the housing. The housing has a recess corresponding to the hook.

The settling member is caught by the catching projection. The hook is inserted into the recess.

The connecting means is a fastener. The fastener includes a first coupling portion coupled to a side of the light source body, a second coupling portion coupled to the housing, and a connecting portion connecting the first coupling portion with the second coupling portion. The second coupling portion has a horizontal hole. An opening is formed in the housing. The housing includes a projection formed in the opening. The fastener is disposed on both sides of the light source body.

The projection has a shape corresponding to the horizontal hole and is inserted into the horizontal hole.

The connecting portion provides elasticity allowing the second coupling portion to be perpendicular to the housing.

The first coupling portion is screw-coupled to the side of the light source body.

The connecting means is a connection member. The connection member includes a lower member coupled to the side of the light source body, an upper member coupled to the housing, and a connection portion which connects the lower member with the upper member. The housing has a hole extending in one direction.

The upper member passes through the hole and is bent at a certain angle with respect to the connection portion, so that the light source body is coupled to the housing.

A width of the upper member is increased toward the top thereof. The width of the upper member is increased, and then is maintained constant or is decreased.

A length of the hole of the housing is greater than the maximum width of the upper member.

The connection member is electrically connected to the light emitting module. The upper member of the connection member is electrically connected to an external power supply and provides external electric power to the light emitting module.

Further another embodiment is a lighting device. The lighting device includes: a housing; and a light source which is attached to and removed from the housing. The light source includes: a light emitting module; a light source body in which the light emitting module is disposed; a cover which is disposed on the light source body and has an opening; a connection member which is disposed between the light source body and the cover and includes a first connection member and a second connection member which are disposed on the light source body; and an elastic body which is disposed between the first connection member and the second connection member.

The lighting device further includes a coupling member which is disposed between the housing and the light source and has an insertion recess.

The elastic body provides an elastic force causing the first connection member and the second connection member to be farther from each other.

The housing has a recess. The first connection member and the second connection member include a horizontal portion disposed on the light source body and a vertical portion extending perpendicular to the horizontal portion. The vertical portion passes through the opening of the cover and is coupled to the recess of the housing or the insertion recess of the coupling member.

The light source body includes a first light source body and a second light source body which is disposed adjacent to the first light source body. The first connection member is disposed on the first light source body. The second connection member is disposed on the second light source body.

The light source body has a guide recess allowing the connection member to be disposed to move in a sliding manner.

Advantageous Effects of Invention

A lighting device in accordance with the present invention has a new structure.

A lighting device in accordance with the present invention is easy to replace and assemble.

A lighting device in accordance with the present invention is attachable to a conventional housing and has a lower manufacturing cost and weight. A lighting device in accordance with the present invention provides indirect light as well as direct light.

A lighting device in accordance with the present invention has improved light efficiency.

BRIEF DESCRIPTION OF THE DRAWINGS

The embodiments will be described in detail with reference to the following drawings in which like reference numerals refer to like elements wherein:

FIG. 1 is a perspective view of a lighting device according to an embodiment of the present invention;

FIG. 2 is an exploded perspective view of the lighting device according to the embodiment of the present invention;

FIG. 3 is a cross sectional view of the lighting device according to the embodiment of the present invention;

FIG. 4*a* is an exploded perspective view showing a housing, a reflector and a coupling member of FIG. 3;

FIG. 4*b* is an exploded perspective view of the coupling member shown in FIG. 3;

FIG. 4*c* is an enlarged view of the coupling member and a light source of FIG. 3;

FIGS. 5 and 6 are perspective views of the light source according to the embodiment;

FIGS. 7 and 8*a* are exploded perspective views of the light source according to the embodiment;

FIG. 8*b* shows an optical cover in which a first reflector and a second reflector are disposed;

FIG. 8*c* shows a path of light reflected by the optical cover in which the first reflector and the second reflector are disposed;

FIG. 9*a* is an exploded perspective view of a body unit of the lighting device according to the embodiment;

FIG. 9*b* is an exploded cross sectional view of the body unit of the lighting device according to the embodiment;

FIG. 9*c* is a cross sectional view of the plural bodies according to the embodiment;

FIG. 10 is an exploded perspective view of a connection member and the body unit of the lighting device according to the embodiment;

FIG. 11 is a cross sectional view of a lighting device according to a modified embodiment;

FIG. 12 is an exploded perspective view of the lighting device according to the modified embodiment;

FIG. 13 is a cross sectional view of a lighting device according to another modified embodiment;

FIG. 14 is an exploded perspective view of the lighting device according to the another modified embodiment.

FIG. 15 is an exploded perspective view showing an electrical connection method of a lighting device according to another embodiment;

FIG. 16 is a side view showing that a housing and a light source body of the lighting device according to the another embodiment have been coupled to each other;

FIG. 17 shows an example of a method for connecting a socket according to the another embodiment to an external power supply;

FIG. 18 is an exploded perspective view showing an electrical connection method of a lighting device according to further another embodiment;

FIG. 19 is a perspective view showing that a socket and a light source body of the lighting device according to the further another embodiment have been coupled to each other;

FIG. 20 is an exploded perspective view showing an electrical connection method of a lighting device according to yet another embodiment;

FIG. 21 is a perspective view showing that a housing and a light source body of the lighting device according to the yet another embodiment have been coupled to each other;

FIG. 22*a* is an exploded perspective view of a lighting device according to still another embodiment;

FIG. 22*b* shows a receiving portion of a socket, which receives a terminal of the light source body;

FIG. 22*c* shows in detail the light source body according to the still another embodiment;

FIG. 23 is an exploded perspective view of a light source body of a lighting device according to still another embodiment;

FIG. 24 is a perspective view showing a state before a housing and the light source of the lighting device according to the still another embodiment are coupled to each other;

FIG. 25 shows a mechanical connection method of a lighting device according to still another embodiment;

FIG. 26 is a perspective view showing that a housing and a light source body of the lighting device according to the still another embodiment have been coupled to each other;

FIG. 27 is a perspective view showing a mechanical connection method of a lighting device according to still another embodiment;

FIG. 28 is a perspective view showing that a housing and a light source body of the lighting device according to the still another embodiment have been coupled to each other;

FIG. 29*a* is an exploded perspective view showing a mechanical connection method of a lighting device according to still another embodiment;

FIG. 29*b* is a perspective view showing that a housing and a light source body of the lighting device according to the still another embodiment have been coupled to each other;

FIG. 30 shows a locking device coupling the housing with the light source body;

FIG. 31 is an exploded perspective view showing a mechanical connection method of a lighting device according to still another embodiment;

FIG. 32 shows a socket coupling a housing with a light source body of the lighting device according to the still another embodiment;

FIG. 33 is an exploded perspective view showing a light source according to still another embodiment;

FIG. 34 is a cross sectional view of the light source according to the still another embodiment;

FIG. 35 is an exploded perspective view of a lighting device according to still another embodiment;

FIG. 36 shows a process of coupling a housing with a light source body according to the still embodiment;

FIG. 37 shows in detail shapes of a connection member before and after the coupling of the housing and the light source body;

FIG. 38 shows a heat concentration when two light source bodies are disposed on the inner upper surface of the housing; and FIG. 39 shows a light source body including heat radiating fins disposed in the central portion thereof.

DETAILED DESCRIPTION

Hereafter, an embodiment will be described in detail with reference to the accompanying drawings. However, it can be easily understood by those skilled in the art that the accompanying drawings are described only for easily disclosing the contents of the present invention and the scope of the present invention is not limited to those of the accompanying drawings.

A criterion for "on" and "under" of each layer will be described based on the drawings. A thickness or a size of each layer may be magnified, omitted or schematically shown for the purpose of convenience and clearness of description. The size of each component may not necessarily mean its actual size.

In description of embodiments of the present invention, when it is mentioned that an element is formed "on" or "under" another element, it means that the mention includes a case where two elements are formed directly contacting with each other or are formed such that at least one separate element is interposed between the two elements. The "on" and "under" will be described to include the upward and downward directions based on one element.

An Embodiment

FIG. 1 is a perspective view of a lighting device 1 according to an embodiment of the present invention. FIG. 2 is an exploded perspective view of the lighting device 1 according to the embodiment of the present invention. FIG. 3 is a cross sectional view of the lighting device 1 according to the embodiment of the present invention. FIG. 4*a* is an exploded perspective view showing a housing, a reflector and a coupling member of FIG. 3. FIG. 4*b* is an exploded perspective view of the coupling member shown in FIG. 3. FIG. 4*c* is an enlarged view of the coupling member and a light source of FIG. 3.

Referring to FIGS. 1 to 4*c*, a lighting device 1 in accordance with an embodiment of the present invention includes a housing 100, a coupling member 110, a reflector 200, a light source 300 and a power supply unit 400.

1. Housing 100 and Coupling Member 110

The housing 100 may have a shape of a box for accepting the coupling member 110 and the reflector 200. While the shape of the housing 100 as viewed from the outside may be quadrangular, the housing 100 may have various shapes without being limited to this.

The housing 100 may be formed of a material which can efficiently release heat. For example, the housing 100 may be formed of a metallic material such as Al, Sn, Ni, Ag, Cu, Ti, Mo, W, Au and Pt and the like.

A hole 107 connecting electrically the power supply unit 400 to an external power supply may be formed on the lateral surface and/or upper surface of the housing 100. The power supply unit 400 which is electrically connected to an external power supply and controls the electric power supply to the light source 300 may be disposed on the lateral surface and/or upper surface of the housing 100.

The housing 100 includes an opening 101 allowing light emitted from the light source 300 to be reflected by the reflector 200 and to be emitted.

Meanwhile, in a case where the lighting device 1 is installed on an external support member such as a ceiling or a wall, an insertion portion corresponding to the shape of the lighting device 1 is formed in the external support member, and then the lighting device 1 is inserted into and fixed to the insertion portion.

The coupling member 110 may be coupled to the inner upper surface of the housing 100. The coupling member 110 may be coupled to the housing 100 in various ways. For example, the coupling member 110 may be coupled to the housing 100 by using a coupling screw, an adhesive and the like.

The coupling member 110 may be formed extending in a first direction on the inner upper surface of the housing 100. For example, the coupling member 110 may be formed extending from one inner wall of the housing 100 to the opposite inner wall of the housing 100.

The reflector 200 is disposed inside the housing 100 and includes a first side 210 and a second side 220. The first side 210 is attached and fixed to the side of the housing 100. The second side 220 is attached and fixed to the side of the coupling member 110.

A first recess 111 may be formed on the outer wall of the coupling member 110. The first recess 111 may be formed extending in the first direction. The second side 220 of the reflector 200 may be inserted into the first recess 111.

The housing 100 and the coupling member 110 may be formed such that the reflector 200 may be attachable thereto and removable therefrom.

A second recess 103 may be formed on the inner wall of the housing 100. The first side 210 of the reflector 200 may be inserted into the second recess 103. It is possible to form the one second recess 103 or a plurality of the second recess 103.

The first side 210 of the reflector 200 is inserted into the second recess 103 of the housing 100, and the second side 220 of the reflector 200 is inserted into the first recess 111 of the coupling member 110. As a result, the housing 100 and the coupling member 110 are able to fix and sustain the reflector 200.

Also, the coupling member 110 may be formed such that the light source 300 may be attachable thereto and removable therefrom.

In insertion recess 112 may be formed in the middle portion of the coupling member 110. A portion of the light source 300 may be inserted into the insertion recess 112. The insertion recess 112 may be formed extending in the first direction.

A third recess 113 may be formed on the inner wall of the insertion recess 112. A connection member 340 of the light source 300 may be inserted into the third recess 113. As a result, the light source 300 can be securely coupled to the coupling member 110 by the third recess 113. The coupling of the light source 300 and the coupling member 110 will be described later in more detail.

A first connection terminal 120 may be formed in the middle portion within the insertion recess 112. When the light source 300 is inserted into the insertion recess 112, the first connection terminal 120 may be coupled to and electrically connected to a second connection terminal 330 of the light source 300. When the first connection terminal 120 is connected to the second connection terminal 330, electric power and/or a driving signal can be transmitted to the light source 300 through the first connection terminal 120 and the second connection terminal 330.

Based on the design of the lighting device 1, it is possible to form the one first connection terminal 120 or a plurality of the first connection terminals 120. More detailed description of the first connection terminal 120 will be provided later together with the detailed description of the second connection terminal 330.

The coupling member 110 also performs a function of directly radiating heat generated from the light source 300 or transferring the heat to the housing 100.

It is recommended that the coupling member 100 is formed of a material capable of efficiently radiating and/or transferring the heat. For example, the coupling member 110 may be formed of a metallic material such as Al, Sn, Ni, Ag, Cu, Ti, Mo, W, Au and Pt and the like.

2. Reflector 200

The reflector 200 may include a first reflector 200*a* and a second reflector 200*b*. The first reflector 200*a* and the second reflector 200*b* are attachable to and removable from the housing 100 and the coupling member 110.

For example, as shown in FIG. 2, the second reflector 200*b* may be coupled to the housing 100 and the coupling member 110 by inserting the second side 220 of the second reflector 200*b* into the first recess 111 of the coupling member 110 and by inserting the first side 210 of the second reflector 200*b* into the second recess 103 of the housing 100.

The second side 220 of the reflector 200 may be formed to have a level difference. The first side 210 of the reflector 200 may be also formed to have a level difference. At least one insertion end may be formed on the first side 210. At least one insertion end which may be inserted into the second recess 103 may be formed on the first side 210 of the reflector 200. The shape of the second recess 103 may be formed corresponding to that of the selection end.

The first reflector 200*a* and the second reflector 200*b* may have a parabola-shaped surface and may be formed extending in the first direction. Therefore, the first reflector 200*a* and the second reflector 200*b* may form a parabolic shape having two paraboloids. Here, the shape of the reflector 200 can be variously changed according to a desired lighting.

The reflector 200 may be formed of a metallic material or a resin material which has high reflection efficiency. For example, the resin material includes any one of PET, PC and PVC resin. The metallic material includes any one of Ag, alloy including Ag, Al, and alloy including Al.

The surface of the reflector 200 may be coated with Ag, Al, white photo solder resist (PSR) ink, a diffusion sheet and the like. Otherwise, an oxide film may be formed on the surface of the reflector 200 by an anodizing process.

Here, the material and color of the reflector 200 are not limited and are variously selected depending on a lighting generated by the lighting device 1.

3. Power Supply Unit 400

When the power supply unit 400 is connected to the light source 300, the power supply unit 400 can supply at least one of electric power and a driving signal.

As shown in FIGS. 2 and 3, the power supply unit 400 may be disposed in a space between the parabola-shaped reflector 200 and the inner surface of the housing 100. That is, due to the parabola shape of the reflector 200, an empty space may be formed between the reflector 200 and the corner inside the housing 100. As a result, the power supply unit 400 may be disposed in the empty space.

The power supply unit 400 can convert alternating current (AC) into direct current (DC) and output the direct current (DC).

The power supply unit 400 may be electrically connected to the light source 300 through a wire, a flexible printed circuit board (FPCB) or the like. For example, the wire or 1-PCB extends from the power supply unit 400 and is electrically connected to the first connection terminal 120 through the hole formed in the coupling member 110, and the first connection terminal 120 is electrically connected to the second connection terminal 330. As a result, the power supply unit 400 is electrically connected to the light source 300.

4. Light Source 300

The lighting device 1 includes the light source 300. The light source 300 may be, as shown in FIG. 1, disposed in the inner center of the housing 100. The light source 300 may be also coupled to the coupling member 110 in an attachable and removable manner.

FIGS. 5 and 6 are perspective views of the light source 300 according to the embodiment. FIGS. 7 and 8*a* are exploded perspective views of the light source 300 according to the embodiment. FIG. 9*a* is an exploded perspective view of a body unit of the lighting device according to the embodiment. FIG. 9*b* is an exploded cross sectional view of the body unit of the lighting device according to the embodiment. FIG. 9*c* is a cross sectional view of the plural bodies of the lighting device according to the embodiment. FIG. 10 is an exploded perspective view of the connection member and the body unit of the lighting device according to the embodiment.

Referring to FIGS. 5 to 10, the light source 300 according to the embodiment includes a first body 310*a*, a second body 310*b*, a first light emitting module 320*a*, a second light emitting module 320*b*, the second connection terminal 330, the connection member 340, a protective cover 360 and an optical cover 380.

The first body 310*a* and the second body 310*b* have the same shape and form the body unit of the light source 300. The light source 300 may be formed extending in the first direction, that is, in the longitudinal direction of the reflector 200.

1) First Body 310*a* and Second Body 310*b*

The light source 300 includes the first body 310*a* and the second body 310*b* in which the first light emitting module 320*a* and the second light emitting module 320*b* are disposed respectively. The first body 310*a* and the second body 310*b* may be designated as the body unit or a light source body.

The first body 310*a* and the second body 310*b* may have a shape shown in FIGS. 7 to 9*c*. Since the first body 310*a* and the second body 310*b* have the same shape, the shape will be described below on the basis of the first body 310*a*.

As shown in FIG. 9*a*, the first body 310*a* may have a straight beam shape extending along a first axis 33 from one side 31 to the other side 32 thereof. The first axis 33 may be randomly selected as the direction of one of straight lines parallel with the lighting surface of the lighting device 1.

FIG. 9*b* is a cross sectional view formed by cutting the first body 310*a* of FIG. 9*a* along a plane perpendicular to the first axis. In the cross section of the first body 310*a*, the first body 310*a* may include a first projection 311, a second projection 314 and a lower projection 317. The first projection 311 projects outwardly from both upper sides of the first body 310*a*. The second projection 314 projects outwardly from both lower sides of the first body 310*a*. The lower projection 317 projects downwardly from both ends of the bottom surface of the first body 310*a*.

According to the cross sectional view, the lower projection 317 is formed parallel with the first axis from the both ends of the bottom surface of the first body 310*a*. Additionally, a seating surface 313 in which the first light emitting module 320*a* is disposed may be formed between the lower projections 317.

As shown in FIG. 9*b*, the first body 310*a* may have a symmetrical shape, and therefore, a member like the first body 310*a* can be used without distinction of right and left. The right side and left side of the first body 310*a* may include the second projection 314 for catching the optical cover 380.

In order that the optical cover 380 is more stably coupled to the first body 310*a*, the second projection 314 may be inclined closer to the top surface of the first body 310*a* the farther it is from the first body 310*a*.

The right side and left side of the first body 310*a* may also include a side recess 312 between the first projection 311 and the second projection 314. When the first body 310*a* and the second body 310*b* are arranged in parallel with the each other such that the sides of the first body 310*a* and the second body 310*b* face each other, the side recess 312 functions as an electrical connection path through which a wire coming from the first light emitting module 320*a* and the second light emitting module 320*b* passes.

FIG. 9*c* is a cross sectional view when the sides of the plural bodies are arranged to face each other. As shown in FIG. 9*c*, a wire path 319 may be formed between the plural bodies by the first projection 311 and the second projection 314.

The wire connected to the first light emitting module 320*a* and the second light emitting module 320*b* so as to receive electric power from an external power supply is disposed within the wire path 319 and can be connected to the second connection terminal 330.

The first projection 311 disposed on the top surface of the body unit may be formed shorter than the second projection 314 in order that the path allowing the wire to be connected to and come from the second connection terminal 330 disposed on the top surfaces of the first body 310*a* and the second body 310*b* is obtained.

The first projection 311 is formed shorter than the second projection 314. Accordingly, when the first body 310*a* and the second body 310*b* are arranged in parallel with each other and the second projections 314 of the first body 310*a* and the second body 310*b* contact with each other, the first projections 311 between the first and the second bodies 310*a* and 310*b* do not contact with each other and are spaced apart from each other at a predetermined interval.

The bottom surface of the first body 310*a* includes the seating surface 313 in which the first light emitting module 320*a* is seated. A substrate may be disposed on the seating surface 313. A plurality of light emitting diodes may be disposed on the substrate. The light emitting diodes may receive electric power through the substrate.

The plurality of the light emitting diodes may be selected, for example, through various combinations of red, green, blue and white light emitting diodes which radiate red, green, blue and white light respectively. The plurality of the light emitting diodes may be arranged in the form of an array.

An optical structure is disposed on the plurality of the light emitting diodes. The optical structure may adjust the light distribution and the color sense of light emitted from the plurality of the light emitting diodes, and may create emotional lighting having various luminance and color senses if necessary.

The seating surface 313 of the first body 310*a* includes plural tap holes 318 which are separated from each other at a predetermined interval. The first light emitting module 320*a* also includes screw holes corresponding to the positions of the tap holes 318 of the seating surface 313 of the first body 310*a*. Additionally, a screw thread for screw-coupling may be formed in at least some of the tap holes 318.

Accordingly, screws pass through the screw holes of the first light emitting module 320*a* and are coupled to the tap holes 318 of the first body 310*a*, so that the first light emitting module 320*a* can be fixed to the seating surface 313 of the first body 310*a*.

An inward locking projection 315 is disposed on both ends of the bottom surface of the first body 310*a*. Here, the side of the protective cover 360 is inserted and fixed into the locking projection 315, so that the protective cover 360 is fixed to the first body 310*a*.

The first body 310*a* functions as a heat sink. The bottom surface of the first body 310*a* functions as a contact surface receiving heat generated from the first light emitting module 320*a*.

The top surface of the first body 310*a* includes a connection recess 316 extending from one end to the other end of the first body 310*a*. The upper portion of the connection recess 316 may be formed corresponding to the shape of a connection portion 342 of the connection member 340 in such a manner that the connection member 340 is fixed and connected to the connection recess 316. The lower portion of the connection portion 316 has a screw thread such that the first body 310*a* is directly connected to the housing 100 by means of a screw and the like.

The connection recess 316 of the top surface of the first body 310*a* is formed extending from one end to the other end of the first body 310*a*. As a result, it is possible to reduce the manufacturing cost and weight of the first body 310*a* and to freely select where the connection member 340 is attached to the first body 310*a* if necessary. Besides, even when the first body 310*a* is directly coupled to the housing 100 by means of a screw and the like, it is also possible to freely select where the screw is coupled.

Contrarily to this, as described above, the tap holes 318 are discretely formed in the bottom surface of the first body 310*a*. This intends to increase a contact area with the first light emitting module 320*a* such that the first body 310*a* efficiently functions as a heat sink.

Accordingly, the plural tap holes 318 which are mutually separated may be formed in the bottom surface of the first body 310*a*, and the connection recess 316 may be formed in the top surface of the first body 310*a* in such a manner as to extend from one end to the other end of the first body 310*a*.

The top surface of the first body 310*a* may include a first surface 30 and a second surface 35. The first surface 30 is directly connected to the connection recess 316. The second surface 35 extends from the first surface 30 to the outside of the first body 310*a*.

When a distance from the bottom surface to the top surface of the first body 310*a* is designated as a height, the height to the first surface 30 may become less toward the connection recess 316, and the height to the second surface 35 may be horizontal and uniform.

In a case where the top surface of the first body 310*a* is horizontal, when the first body 310*a* is screw-coupled to the inner upper surface of the housing 100 through the connection recess 316, only the portion where the connection recess 316 is formed closely contacts with the inner upper surface of the housing 100, and the outer portion of the top surface of the first body 310*a* may not closely contact with the inner upper surface of the housing 100.

Contrarily, in a case where the height to the first surface 30 of the top surface of the first body 310*a* becomes less toward the connection recess 316 and the height to the second surface 35 of the top surface of the first body 310*a* is horizontal and uniform, as a screw is tightened, the first surface 30 in which the connection recess 316 is disposed comes in close contact with the inner upper surface of the housing 100, and then the second surface 35, i.e., the outer portion of the top surface, also comes in close contact with the inner upper surface of the housing 100. Accordingly, a contact area of the housing 100 and the first body 310*a* becomes greater, so that excellent thermal conductivity and the like can be obtained.

Although the described light source includes the plural light source bodies, the light source may include one light source body which is coupled to the housing or the coupling member.

The light source body may have a surface inclined toward the reflector. The light emitting module may be disposed on the inclined surface. In this case, indirect light reflected by the reflector is emitted through the lighting device.

2) Connection Member 340 and Coupling Cap 350

The connection member 340 is disposed in the connection recess 316 of the surfaces of the first and the second bodies 310*a* and 310*b* and is caught and fixed to the third recess 113 of the coupling member 110. Therefore, the connection member 340 functions to attach and fix the light source 300 to the coupling member 110.

The connection member 340 includes the connection portion 342 which has a shape corresponding to the shape of the upper portion of the connection recess 316 in such a manner that the connection member 340 is attached and fixed to the connection recess 316 of the first and the second bodies 310*a* and 310*b*. The connection member 340 also includes a coupling projection 344 such that the connection member 340 is caught and fixed to the third recess 113 of the coupling member 110.

The connection member 340 may be inserted and fixed to the upper portion of the connection recess 316 of the first and the second bodies 310*a* and 310*b* in a sliding manner. Since the connection recess 316 of the first and the second bodies 310*a* and 310*b* extend from one end to the other end of the first and the second bodies 310*a* and 310*b* respectively, the connection member 340 slides with the fixing to the connection recess 316 and then may be disposed at a desired position of the top surfaces of the first and the second bodies 310*a* and 310*b*.

A spring 370 may be disposed between the vertical planes of the connection member 340. For example, as shown in FIGS. 7 and 8, the spring 370 may have a 'V'-shape or 'U'-shape of which the lower portion is flat and may be disposed contacting with the vertical planes of the connection member 340 and the top surfaces of the first and the second bodies 310*a* and 310*b*.

The spring 370 is able to cause the light source 300 to be securely coupled to the insertion recess 112 of the coupling member 110 by providing an elastic force to the vertical plane of the connection member 340. The spring 370 may provide the vertical plane of the connection member 340 with the elastic force widening the interval between the vertical planes of the connection member 340.

In other words, the spring 370 performs a function of pushing outward the vertical planes of the connection member 340. Therefore, when the light source 300 is inserted into the coupling member 110, the connection member 340 coupled to the surfaces of the first and the second bodies 310*a* and 310*b* may be securely coupled to the third recess 113 of the coupling member 110 by the force from the spring 370.

Heat generated from the plurality of the light emitting diodes is radiated by the body of the light source 300 or is transferred to the coupling member 110 through the connection member 340 connecting the first and the second bodies 310*a* and 310*b* to the coupling member 110, and is radiated. Thus, it is recommended that the first body 310*a* and the second body 310*b* are formed of a material capable of effectively radiating the heat.

For example, the first body 310*a* and the second body 310*b* may be formed of a metallic material such as Al, Sn, Ni, Ag, Cu, Ti, Mo, W, Au and Pt and the like. Additionally, a portion of the light source 300 has an uneven structure capable of effectively radiating the heat.

The first body 310*a* and the second body may be coupled to each other by coupling a coupling cap 350 to one ends of the first and the second bodies 310*a* and 310*b*.

As shown in FIG. 9*b*, a first recess 361 may be formed in one side of the first and the second bodies 310*a* and 310*b*.

Referring to FIGS. 7 and 8*a*, the coupling cap 350 may include a through-hole 355 formed at a position corresponding to the first recess 361. Screws pass through the through-holes 355 of the coupling cap 350 and are coupled to the first recess 361. As a result, the coupling cap 350 is fixed to at least one ends of the first and the second bodies 310*a* and 310*b*, so that the first and the second bodies 310*a* and 310*b* can be coupled to each other.

3) First Connection Terminal 120 and Second Connection Terminal 330

As shown in FIGS. 4*b* and 4*c*, the first connection terminal 120 for electrical connection to the light source 300 may be disposed on the central portion of the coupling member 110. The first connection terminal 120 may be electrically connected to the power supply unit 400 by means of a wire and the like.

As shown in FIGS. 7 and 8, the second connection terminal 330 may be disposed on the first and the second bodies 310*a* and 310*b* in order to supply electric power to the light source 300.

A wire connected to the first light emitting module 320*a* and a wire connected to the second light emitting module 320*b* pass through a space between the first and the second bodies 310*a* and 310*b* and may be connected to the second connection terminal 330 disposed on the central portion of the top surface of the first and the second bodies 310*a* and 310*b*.

As such, the space formed by both the side recess 312 of the first body 310*a* and the side recess 312 of the second body 310*b* functions as a space where the wire is placed. Therefore, this makes it easier to arrange the wire for electrical connection.

When the light source 300 is inserted into the coupling member 110, the second connection terminal 330 is coupled to the first connection terminal 120 formed in the insertion recess 112 of the coupling member 110. Accordingly, the light source 300 can be electrically connected.

As a result, the power supply unit 400 may supply electric power and/or a driving signal to the light source 300 through the first connection terminal 120 and the second connection terminal 330.

The first connection terminal 120 and the second connection terminal 330 may be a D-sub connector. In this case, if the first connection terminal 120 includes a pin, the second connection terminal 330 includes a hole, and if the first connection terminal 120 includes a hole, the second connection terminal 330 includes a pin. Therefore, the first connection terminal 120 and the second connection terminal 330 may be electrically and physically connected to each other.

4) Optical Cover 380

The optical cover 380 is coupled to the side of the body unit comprised of the first and the second bodies 310*a* and 310*b*. The optical cover 380 may be disposed under the first and the second bodies 310*a* and 310*b* and may function as an optical member.

The optical cover 380 may be comprised of a first surface 383 and a second surface 386. The first surface 383 faces the light emitting directions of the first light emitting module 320*a* and the second light emitting module 320*b*, both of which are disposed on the bottom surfaces of the first and the second bodies 310*a* and 310*b* respectively. The second surface 386 connects the body unit with the first surface 383 and faces the reflector 200.

A part of light emitted from the first light emitting module 320*a* and the second light emitting module 320*b* may be reflected by the first surface 383 of the optical cover 380 and may pass through the second surface 386. The light which has passed through the second surface 386 is reflected by the reflector 200 and is emitted to the downside of the housing 100.

That is, the light emitted from the first light emitting module 320*a* and the second light emitting module 320*b* not only irradiates a lighting area as direct light by transmitting through the first surface 383 of the optical cover 380 but also irradiates a lighting area as indirect light by being reflected by the first surface 383 of the optical cover 380 and the reflector 200. As described, the lighting device 1 is able to provide indirect light as well as direct light.

FIG. 8*b* shows an optical cover in which a first reflector and a second reflector are disposed.

A reflective member may be disposed on the first surface 383 of the optical cover 380. The reflective member may include a first reflector 385 disposed in the central portion of the bottom surface. The reflective member may include a second reflector 387 disposed in both sides of the bottom surface.

As shown in FIG. 8*b*, the first reflector 385 may have a triangular shape in such a manner that the light is reflected upwardly and outwardly from the optical cover 380.

FIG. 8*c* shows a path of light reflected by the optical cover in which the first reflector and the second reflector are disposed.

In FIG. 8*c*, the second surface 386 through which most of the light transmits is omitted. A part of the light emitted from the light source body is reflected by the first surface 383 and the other part of light transmits through the first surface 383 and is emitted outwardly.

After a part of the light emitted from the light source body is reflected by the first reflector 385 and the second reflector 387 which are disposed on the first surface 383, the part of the light is reflected again by the reflectors 200*a* and 200*b*, and then is irradiated outwardly.

Since the first reflector 385 and/or the second reflector 387 are disposed on the first surface of the optical cover 380, it is possible to increase a ratio of the indirect light by increasing the amount of the light reflected by the reflectors 200*a* and 200*b*.

The protective cover 360 may be disposed between the body unit and the optical cover 380. The protective cover 360 is able to protect the first light emitting module 320*a* and the second light emitting module 320*b* from moisture and the like which may be introduced into the light source 300.

The protective cover 360 may also function as an optical member. The protective cover 360 is capable of perform a function of uniformly dispersing the light emitted from the first light emitting module 320*a* and the second light emitting module 320*b*.

The protective cover 360 and/or the optical cover 380 may include at least one of a lens, a diffusion sheet and a phosphor luminescent film (PLF). The lens may include various lenses such as a concave lens, a convex lens and a condensing lens and so on according to a design of the lighting device.

The diffusion sheet is capable of uniformly diffusing the light emitted from the plurality of the diodes.

The phosphor luminescent film (PLF) may include a fluorescent material. Since the fluorescent material included in the phosphor luminescent film (PLF) is excited by light emitted from the first light emitting module 320*a* and the second light emitting module 320*b*, the lighting device can create emotional lighting having various color senses by mixing first light emitted from the first light emitting module 320*a* and the second light emitting module 320*b* and second light excited by the fluorescent material.

For example, when the first light emitting module 320*a* and the second light emitting module 320*b* emit blue light and the phosphor luminescent film (PLF) includes a yellow fluorescent material excited by blue light, the lighting device emits white light by mixing the blue light and yellow light.

The protective cover 360 and/or the optical cover 380 may be easily replaced by any one of a lens, a diffusion sheet and a phosphor luminescent film (PLF).

5. Coupling and Separation of Light Source 300 and Coupling Member 110

1) Coupling Process

The light source 300 is attachable to and removable from the coupling member 110.

First, an interval of the connection member 340 is reduced by applying a first force F to the connection member 340 disposed on the first and the second bodies 310*a* and 310*b* of the light source 300. Here, the direction of the first force F may be reverse to the direction of the elastic force applied by the spring 370.

If the first force F is not applied, the interval between the first connection member and the second connection member of the connection member 340 is great by the elastic force from the spring 370, so that it is difficult to insert the light source 300 into the insertion recess 112 of the coupling member 110.

The light source 300 is inserted into the insertion recess 112 of the coupling member 110 by applying the first force F to the connection member 340. After the connection member 340 is inserted into the insertion recess 112, the first force F is stopped from being applied. Then, the interval of the connection member 340 is increased again, and then the coupling projection 344 of the connection member 340 disposed on the light source 300 may be inserted into the third recess 113 formed on the inner surface of the insertion recess 112. As a result, the light source 300 is inserted into the coupling member 110.

After the light source 300 is coupled to the coupling member 110, the spring 370 disposed in the interval of the connection member 340 causes the first body 310*a* and the second body 310*b* to push each other apart. Accordingly, the connection member 340 can be securely coupled to the third recess 113.

Also, the spring 370 gives continuously a uniform pressure to a contact surface of the connection member 340 and the insertion recess 112. Accordingly, heat generated from the light source 300 may be efficiently transferred through the contact surface of the connection member 340 and the coupling member 110.

2) Separation Process

When the light source 300 is required to repair, the light source 300 may be separated from the coupling member 110.

In separating the light source 300 from the coupling member 110, after the interval of the connection member 340 is reduced by applying the first force F to the connection member 340, the light source 300 is separated from the coupling member 110.

Modified Embodiment

FIG. 11 is a cross sectional view of a lighting device 2 according to a modified embodiment. FIG. 12 is an exploded perspective view of the lighting device 2 according to the modified embodiment.

In description of the lighting device 2 according to the modified embodiment, repetitive descriptions thereof will be omitted.

Referring to FIGS. 11 and 12, the lighting device 2 may include a housing 500, a body unit 700 coupled to the housing 500, reflectors 600*a* and 600*b* disposed between the housing 500 and the body unit 700, a protective cover 730 coupled to the lower portion of the body unit 700 and an optical cover 740.

The inner surface of the housing 500 may be coated with a reflective material. Therefore, instead of disposing the reflectors 600*a* and 600*b*, the inner surface of the housing 500 is able to perform the function of the reflectors 600*a* and 600*b*.

A clip 510 is disposed on the inner upper surface of the housing 500 of the lighting device 2. The clip 510 may be coupled to the housing 500 in various manners. For example, the clip 510 may be coupled to the housing 500 by means of a coupling screw, an adhesive and the like.

The clip 510 includes an opening into which the body unit 700 is inserted. Both sides of the clip 510 include an extension projection to which one side of the reflector is coupled. The body unit 700 is inserted and fixed into the clip 510 through the opening of the clip 510. As a result, the body unit 700 is coupled to the housing 500.

The body unit 700 of the modified embodiment may have the same shape as that of the first body 310*a* or the second body 310*b* of the foregoing embodiment.

A light emitting module 710 may be disposed on the bottom surface of the body unit 700. A protective cap 720 may be coupled to the ends of the body unit. The protective cover 730 and the optical cover 740 may be disposed under the body unit 700.

Even though FIGS. 11 and 12 show that the clips 510 are arranged in a line and one body unit 700 is provided, the clips 510 may be arranged in plural lines a plurality of the body units 700 may be also provided.

A part of the light emitted from the light emitting module 710 is irradiated as direct light by the bottom surface 743 of the optical cover 740, and the other part of the light is reflected by the bottom surface 743 of the optical cover 740 and passes through a lateral surface 746 of the optical cover 740. The light which has passed through the lateral surface 746 is reflected by the reflectors 600*a* and 600*b* and is irradiated as indirect light.

FIG. 13 is a cross sectional view of a lighting device 3 according to another modified embodiment. FIG. 14 is an exploded perspective view of the lighting device 3 according to the another modified embodiment.

Referring to FIGS. 13 and 14, an upper surface hole 810 is disposed in the inner upper surface of a housing 800 of the lighting device 3.

Each body of the body unit 1000 according to the another embodiment may have the same shape as that of the first body 310*a* or the second body 310*b* according to the embodiment. Although FIGS. 13 and 14 show that the body unit 1000 is formed by connecting two light source bodies, the number of the light source bodies is not limited and numbers of the light source bodies may be connected to each other.

A recess 1016 may be formed in the top surface of the body unit 1000 in such a manner as to extend from one end to the other end of the body unit 1000. A screw thread may be formed in the lower portion of the recess 1016.

The top surface of the body unit 1000 is disposed on the inner upper surface of the housing 800 in such a manner that the recess 1016 of the body unit 1000 correspond to the upper surface holes 810 of housing 800. Screws pass through the upper surface holes 810 of housing 800 and are coupled to the recess 1016 of the body unit 1000. Accordingly, the body unit 1000 can be fixed to the inner upper surface of the housing 800.

The coupling of the body unit 1000 and the housing 800 through the screw-coupling method causes the body unit 1000 to be tightly coupled to the housing 800. As a result, thermal conductivity can be improved by radiating more heat generated from the body unit 1000.

A light emitting module 1010 may be disposed on the bottom surface of the body unit 1000. A protective cap 1020 may be coupled to the side of the body unit 1000. A protective cover 1030 and an optical cover 1040 may be disposed under the body unit 1000.

The optical cover 1040 may include a bottom surface 1043 and a lateral surface 1046. The bottom surface 1043 faces the light emitting directions of the light emitting module 1010. The lateral surface 1046 faces the inner surface of the housing 800.

A part of the light emitted from the light emitting module 1010 is irradiated as direct light by the bottom surface 1043 of the optical cover 1040, and the other part of the light is reflected by the bottom surface 1043 of the optical cover 1040 and passes through a lateral surface 1046 of the optical cover 1040. The light which has passed through the lateral surface 1046 is reflected by reflectors 900*a* and 900*b* and is irradiated as indirect light.

Examples of Coupling Methods

Hereafter, various electrical connection methods and mechanical connection methods of the described lighting device will be described.

Like the described lighting device, a lighting device to be described below may include components, for example, a power supply unit, an optical cover, a protective cover, a coupling member and the like. However, the repetitive descriptions having matters unrelated to the electrical connection and mechanical connection will be omitted.

FIG. 15 is an exploded perspective view showing an electrical connection method of a lighting device according to another embodiment. FIG. 16 is a side view showing that a housing and a light source body of the lighting device according to the another embodiment have been coupled to each other.

Referring to FIG. 15, the lighting device according to the another embodiment may include a housing 1100, a light source body 1300 coupled to the inner upper surface of the housing 1100, an end cap 1350 covering at least one side of the light source body 1300, and a socket 1400 which is disposed on the outer upper surface of the housing 1100 and is connected to the light source body 1300.

In the following drawings, only the upper surface of the housing 1100, which is coupled to the light source body 1300 may be shown without both sides of the housing 1100.

A light emitting module 1310 may be disposed on one side of the light source body 1300. A terminal 1320 which is electrically connected with the light emitting module 1310 may be disposed in at least one side of the light source body.

The upper surface of the end cap 1350 covering one side of the light source body 1300 is formed to have an opening 1355. As shown in FIG. 16, the socket 1400 passes through the housing 1100 and is inserted into the opening 1355 of the end cap 1350. Accordingly, the socket 1400 contacts with the terminal 1320.

Through this, the socket 1400 may be electrically connected to the terminal 1320 connected electrically to the light emitting module 1310.

The light source body 1300 may be electrically connected to an external power supply through the socket 1400. As shown in FIGS. 15 and 16, a fixing clip 1150 passes downwardly through the housing 1100 from the top surface of the housing 1100 and fixes the light source body 1300 to the housing 1100.

FIG. 17 shows an example of a method for connecting a socket according to the another embodiment to an external power supply.

The socket 1400 may include a horizontal portion 1410 and a vertical projection 1420. The horizontal portion 1410 is disposed on the outer upper surface of the housing 1100. The vertical projection 1420 is disposed perpendicular to the horizontal portion 1410.

A connector 1450 may be disposed on one side of the vertical projection 1420 of the socket 1400. A conductive member connected to the connector 1450 may be disposed within the vertical projection 1420.

As shown in FIG. 17, the conductive member within the vertical projection 1420 may be connected to the external power supply through an insertion pin 1480 and the like.

The housing 1100 may have a through-hole 1110. The horizontal portion 1410 of the socket 1400 is, as shown in FIG. 16, disposed on the outer upper surface of the housing 1100. The vertical projection 1420 of the socket 1400 may pass through the through-hole 1110 and project downwardly from the housing 1100.

The connector 1450 is disposed on one side of the vertical projection 1420. The connector 1450 of the vertical projection 1420 which has passed through the opening 1355 of the end cap 1350 may contact with the terminal 1320 connected electrically with the light emitting module 1310.

As shown in FIGS. 15 and 16, plural light source bodies 1300 may be coupled to the housing 1100. Each of the light source bodies 1300 includes the light emitting module 1310 on one side thereof and the terminal 1320 connected to the light emitting module 1310.

The number of the vertical projections 1420 of the socket 1400 is the same as the number of the light source bodies 1300. The opening 1355 of which the number is the same as the number of the light source bodies 1300 may be disposed on the upper surface of the end cap 1350 which couples the plural light source bodies 1300.

FIG. 18 is an exploded perspective view showing an electrical connection method of a lighting device according to further another embodiment. FIG. 19 is a perspective view showing that a socket and a light source body of the lighting device according to the further another embodiment have been coupled to each other.

Referring to FIG. 18, the lighting device according to the further another embodiment may include a housing 2100, a light source body 2300 coupled to the inner upper surface of the housing 2100, and a socket 2400 which is coupled to the housing 2100 and the light source body 2300.

A receiving recess 2350 receiving the socket 2400 is formed in at least one side of the light source body 2300. A conductive terminal 2320 which is electrically connected with a light emitting module 2310 may be disposed on one side of the receiving recess 2350.

The socket 2400 may include a connector 2450 and a hook 2420. The connector 2450 may be disposed in a portion of the socket 2400, which contacts with the terminal 2320 when the socket 2400 is received in the receiving recess 2350. The hook 2420 which is coupled to the housing 2100 the may be disposed on the top surface of the socket 2400. A hole 2110 may be formed in the housing 2100 and the hook 2420 inserted into the hole 2110 of the housing 2100.

Though not shown, the light source body 2300 may be, as shown in FIGS. 15 and 16, mechanically coupled to the inner upper surface of the housing 2100 by using a means like a fixing clip and the like.

In the socket 2400 shown in FIG. 18, the connector 2450 of the socket 2400 of the lighting device according to the further another embodiment may be connected to a conductive member within the socket 2400. The conductive member may be electrically connected to an external power supply through the hook 2420.

As shown in FIG. 18, the conductive terminal 2320 may be disposed on the bottom surface of the receiving recess 2350. The connector 2450 of the socket 2400 may be disposed on the lower surface of the socket 2400. Here, when the socket 2400 is received into the receiving recess 2350, the connector 2450 may contact with the conductive terminal 2320.

Also, the conductive terminal 2320 may be disposed on the lateral surface of the receiving recess 2350. The connector 2450 of the socket 2400 may be disposed on the lateral surface of the socket 2400.

The light emitting module 2310 disposed on one side of the light source body 2300 may include a substrate 2311, a light emitting device 2315 disposed on one side of the substrate 2311, and the conductive terminal 2320 disposed on the other side of the substrate 2311.

The light emitting module 2310 may be disposed on the lower surface of the light source body 2300. An opening may be formed in the bottom surface of the receiving recess 2350 of the light source body 2300. The terminal 2320 disposed on the other side of the substrate 2311 may be exposed through the opening. When the socket 2400 is received in the receiving recess 2350, the connector 2450 on the lower surface of the socket 2400 may contact with the terminal 2320.

FIG. 20 is an exploded perspective view showing an electrical connection method of a lighting device according to yet another embodiment. FIG. 21 is a perspective view showing that a housing and a light source body of the lighting device according to the yet another embodiment have been coupled to each other.

Referring to FIG. 20, the lighting device according to the yet another embodiment may include a housing 3100, a light source body 3300 coupled to the inner upper surface of the housing 3100, and a socket 3400 which is disposed on the outer upper surface of the housing 3100 and is coupled to the light source body 3300.

As shown in FIG. 20, a projecting terminal 3340 is disposed in at least one side of the light source body 3300. The socket 3400 has a receiving recess 3420 receiving the terminal 3340. The socket 3400 may be electrically connected to the terminal 3340 received in the receiving recess 3420.

A connector 3430 may be disposed in the receiving recess 3420. When the projecting terminal 3340 is received in the receiving recess 3420, the connector 3430 may contact with the terminal 3340.

A light emitting module (not shown) is disposed on at least one side of the light source body 3300. The terminal 3340 may be electrically connected to the light emitting module.

The socket 3400 may include a horizontal portion 3410 and a vertical projection 3450. The horizontal portion 3410 is disposed on the outer upper surface of the housing 3100. The vertical projection 3450 is disposed perpendicular to the horizontal portion 3410.

A through-hole 3110 may be disposed in the housing 3100. The vertical projection 3450 of the socket 3400 may pass through the through-hole 3110 of the housing 3100 and project downwardly from the housing 3100.

FIG. 22*a* is an exploded perspective view of a lighting device according to still another embodiment. FIG. 22*c* shows in detail the light source body according to the still another embodiment.

As shown in FIG. 22*a*, a reflector 4200 may be disposed inside a housing 4100. A light source body 4300 may have a surface inclined toward the reflector 4200.

A light emitting module 4310 may be disposed on the inclined surface. The light emitting module 4310 may irradiate light toward the reflector 4200. The light irradiated to the reflector 4200 may be uniformly reflected and emitted downward from the lighting device.

A socket 4400 may be, as shown in FIG. 22*a*, disposed to extend from the side of the housing 4100. As a result, the light source body 4300 which is connected to the socket 4400 may be disposed apart from the housing 4100.

The socket 4400 may have a receiving portion 4420 which is disposed to support a terminal 4350 projecting from the side of the light source body 4300. A connector 4430 may be disposed within the receiving portion 4420 and be electrically connected to the terminal 4350.

FIG. 22*b* shows the receiving portion of the socket, which receives the terminal of the light source body.

As shown in FIG. 22*b*, the receiving portion 4420 has a shape corresponding to the shape of the terminal 4350 of the light source body 4300 shown in FIG. 22*c*. Accordingly, the terminal 4350 can be inserted into the receiving portion 4420.

The socket 4400 and the terminal 4350 of the light source body 4300 which are shown in FIGS. 22*b* and 22*c* allow the light source body 4300 to be, as shown in FIG. 22*a*, disposed apart from the housing 4100.

As a result, a space for air flow is created between the housing 4100 and the top surface of the light source body 4300. Therefore, more heat generated from the light source body 4300 can be radiated through the space.

FIG. 23 is an exploded perspective view of a light source body of a lighting device according to still another embodiment. FIG. 24 is a perspective view showing a state before a housing and the light source of the lighting device according to the still another embodiment are coupled to each other.

Referring to FIGS. 23 and 24, the lighting device according to the still another embodiment may include a housing 5100, a light source body 5300 coupled to the inner upper surface of the housing 5100, and a coupler 5400 which includes a horizontal portion 5410 and a vertical portion 5420. The vertical portion 5420 has a screw shape and is disposed perpendicular to the center of the horizontal portion 5410.

The coupler 5400 is disposed within the light source body 5300 in such a manner that the horizontal portion 5410 of the coupler 5400 passes through the upper surface of the light source body 5300. The vertical portion 5420 is screw-coupled to the inner upper surface of the housing 5100, so that the top surface of the light source body 5300 may be coupled to the inner upper surface of the housing 5100.

The light source body 5300 may include a lower body 5330 and an upper body 5370 covering the top surface of the lower body 5330. A horizontal recess 5350 in which the horizontal portion 5410 of the coupler 5400 is disposed may be disposed in the lower body 5330. A through-hole 5375 through which the vertical portion 5420 of the coupler 5400 disposed in the lower body 5330 passes may be formed in the upper body 5370.

The vertical portion 5420 is screw-coupled to the inner upper surface of the housing 5100, so that the top surface of the light source body 5300 may be coupled to the inner upper surface of the housing 5100.

The horizontal portion 5410 of the coupler may have a circular shape. A sawtooth shape may be formed on the circumference of the horizontal portion 5410. A portion of the horizontal portion 5410 may project outwardly from the light source body 5300.

Accordingly, a user is able to cause the coupler 5400 to be screw-coupled to the housing 5100 by rotating the sawtooth-shaped circumferential portion of the coupler.

Meanwhile, FIGS. 23 and 24 show the coupler 5400 is disposed on both sides of the light source body 5300, the one coupler 5400 may be disposed in the center of the light source body 5300.

FIG. 25 shows a mechanical connection method of a lighting device according to still another embodiment. FIG. 26 is a perspective view showing that a housing and a light source body of the lighting device according to the still another embodiment have been coupled to each other.

Referring to FIG. 25, the lighting device according to the still another embodiment may include a housing 6100, a light source body 6300 coupled to the inner upper surface of the housing 6100, and a fixing box 6400 disposed on the outer upper surface of the housing 6100.

An insertion member 6350 is disposed on the top surface of the light source body 6300. When the light source body 6300 is coupled to the inner upper surface of the housing 6100, the insertion member 6350 is inserted into the fixing box 6400 and fixed within the fixing box 6400. The fixing box 6400 may be formed of polycarbonate (PC). The insertion member 6350 may be formed of stainless steel.

The insertion member 6350 disposed on the light source body 6300 may include a coupling portion 6351 coupled to the light source body 6300, a contacting portion 6353 inserted into the fixing box 6400, and a connection portion 6355 connecting the coupling portion 6351 with the contacting portion 6353.

As shown in FIG. 25, the width of the contacting portion 6353 decreases with the approach to the upper portion thereof. The width of the connection portion 6355 may be designed to be less than the width of the lowest portion of the contacting portion 6353.

A pair of mutually facing elastic bodies 6410 may be disposed within the fixing box 6400. The elastic bodies 6410 may have an elastic force causing themselves to be closer to each other. A support 6430 may be disposed in the lower portion of the elastic bodies 6410. The support 6430 may have, as shown in FIG. 25, a circular shape and may be formed of rubber having high frictional force so as to stably hold the insertion member 6350.

According to such a structure, when the insertion member 6350 is inserted into the fixing box 6400, the contacting portion 6353 of the insertion member 6350 is disposed between the elastic bodies 6410. The contacting portion 6353 may contact with the elastic bodies 6410. The support 6430 may be disposed in the lower portion of the contacting portion 6353 and may fix the insertion member 6350.

The insertion member 6350 may be formed of a conductive material and may be electrically connected to a light emitting module 6320 disposed on the light source body 6300. The elastic bodies 6410 within the fixing box 6400 may be also formed of a conductive material and may function as a connector. The connector is connected to an external power supply and transfers external electric power to the light emitting module 6320.

FIG. 27 is a perspective view showing a mechanical connection method of a lighting device according to still another embodiment. FIG. 28 is a perspective view showing that a housing and a light source body of the lighting device according to the still another embodiment have been coupled to each other.

Referring to FIG. 27, the lighting device according to the still another embodiment may include a housing 7100, a light source body 7300 coupled to the inner upper surface of the housing 7100, and a fastener 7400 which couples the housing 7100 to the light source body 7300.

The fastener 7400 may include a rotating member 7430 including a first hinge and a second hinge, a fixing member 7440 coupled to the first hinge and the housing 7100, and a settling member 7450 of which one end is coupled to the second hinge and of which the other end is coupled to the light source body 7300.

The fastener 7400 is disposed on and coupled to both sides of the light source body 7300, so that the light source body 7300 is coupled to the inner upper surface of the housing 7100.

In order to stably couple the light source body 7300 to the housing 7100, the fastener 7400 may be disposed on both sides of the light source body 7300 and disposed on the inner upper surface of the housing 7100. For more stable coupling, as shown in FIG. 27, the fasteners 7400 may be disposed at four positions. The number of the fasteners 7400 is not limited to this.

As shown in FIG. 27, the rotating member 7430 may include a hook 7435 which is coupled to the inner upper surface of the housing 7100. The housing 7100 may have a recess to which the hook 7435 is coupled. The recess is formed at a position of the housing 7100, which corresponds to the position of the hook 7435.

A catching projection 7320 may be dispose on both sides of the light source body 7300. The settling member 7450 may be caught by the catching projection 7320.

The light source body 7300 is coupled to the housing 7100 in the following order. After the light source body 7300 is disposed on the inner upper surface of the housing 7100, the settling member 7450 is caught by the catching projection 7320 of the light source body 7300. Then, the hook 7435 is coupled to the upper surface of the housing 7100 by outwardly rotating the rotating member 7430, and then the settling member 7450 is fixed. As a result, the light source body 7300 is fixed to the inner upper surface of the housing 7100.

FIG. 29*a* is an exploded perspective view showing a mechanical connection method of a lighting device according to still another embodiment. FIG. 29*b* is a perspective view showing that a housing and a light source body of the lighting device according to the still another embodiment have been coupled to each other. FIG. 30 shows a locking device coupling the housing with the light source body.

Referring to FIG. 29*a*, the lighting device according to the still another embodiment may include a housing 8100, a light source body 8300 coupled to the inner upper surface of the housing 8100, and a fastener 8400 which couples the housing 8100 to the light source body 8300.

The fastener 8400 may include a first coupling portion 8410 coupled to a side of the light source body 8300, a second coupling portion 8420 coupled to the housing 8100, and a connecting portion 8430 connecting the first coupling portion 8410 with the second coupling portion 8420. The first coupling portion 8410 may be screw-coupled to the side of the light source body 8300.

The second coupling portion 8420 has a horizontal hole 8440. The housing 8100 has an opening 8110 and a projection 8115 formed in the opening 8110. The projection 8115 has a shape corresponding to the shape of the horizontal hole 8440. When the light source body 8300 is coupled to the inner upper surface of the housing 8100, the projection 8115 is inserted into the horizontal hole 8440.

In order to stably couple the light source body 8300 to the housing 8100, the fastener 8400 may be disposed on both sides of the light source body 8300. The number of the fasteners 8400 is also not limited to this.

The connecting portion 8430 may have elasticity. The elasticity allows the second coupling portion 8420 coupled to the housing 8100 to stand perpendicular to the housing 8100.

FIG. 31 is an exploded perspective view showing a mechanical connection method of a lighting device according to still another embodiment. FIG. 32 shows a socket coupling a housing with a light source body of the lighting device according to the still another embodiment.

Referring to FIG. 31, the lighting device according to the still another embodiment may include a housing 8600, a light source body 8700 coupled to the inner upper surface of the housing 8600, and a socket 8800 which couples the housing 8600 to the light source body 8700.

The socket 8800 may include a catching projection 8810 disposed parallel with the light source body 8700, and a connecting portion 8820 disposed perpendicular to the catching projection 8810. A connector 8830 may be disposed on one side of the connecting portion 8820.

A recess having a shape corresponding to the shape of the socket 8800 may be formed in at least one side of the light source body 8700. A terminal 8710 may be disposed at a position of the recess, which corresponds to the position of the connector 8830 of the socket 8800. A light emitting module 8720 may be disposed on at least one side of the light source body 8700. The light emitting module 8720 may be electrically connected to the terminal 8710.

A hook 8840 which is coupled to the housing 8600 may be disposed on the top surface of the connecting portion 8820 of the socket 8800. A hole may be formed in a position of the housing 8600, which corresponds to the position of the hook 8840. The hole has a shape allowing the hook 8840 to passes through and to be coupled to the hole.

A conductive material may be disposed within the connecting portion 8820. The conductive material is electrically connected to the connector 8830. Therefore, the conductive material may be electrically connected to an external power supply through the hook 8840. Through this structure, external electric power can be supplied to the light emitting module 8720.

FIG. 33 is an exploded perspective view showing a light source according to still another embodiment. FIG. 34 is a cross sectional view of the light source according to the still another embodiment.

A light source 9000 of FIGS. 33 and 34 may be coupled to the housing 100 and the coupling member 110 of FIGS. 4*a* to 4*c*.

The lighting device according to the still another embodiment may include the housing 100, the coupling member 110, a light source 9000. The coupling member 110 is coupled to the inner upper surface of the housing 100. The light source 9000 is attachable to and removable from the coupling member 110. The light source 9000 may be directly coupled to the housing 100 having a recess, without the use of the coupling member 110.

The light source 9000 may include a light source body 9100, a cover 9200 disposed to cover the light source body 9100, a connection member which is disposed between the light source body 9100 and the cover 9200 and includes a first connection member 9113 and a second connection member 9115 which are disposed on the top surface of the light source body 9100, and an elastic body 9118 disposed between the first connection member 9113 and the second connection member 9115.

The elastic body 9118 provides an elastic force causing the first connection member 9113 and the second connection member 9115 to be farther from each other. Accordingly, it is possible to enhance a coupling force between the connection member and the coupling member 110.

The first connection member 9113 and the second connection member 9115 may include a horizontal portion 9117 and a vertical portion 9119. The horizontal portion 9117 is disposed on the top surface of the light source body 9100. The vertical portion 9119 extends perpendicular to the horizontal portion 9117. The vertical portion 9119 may pass through the cover 9200 and may be coupled to the coupling member 110.

The upper surface of the cover 9200 may have an opening 9210 allowing the vertical portion 9119 to move. Since the cover 9200 may cover the sides of the light source body 9100, both sides of the cover 9200 may have holes for the horizontal portions 9117 of the first connection member 9113 and the second connection member 9115.

The horizontal portion 9117 may project outwardly from the light source body 9100. A user is able to control a distance between the vertical portion 9119 of the first connection member 9113 and the vertical portion 9119 of the second connection member 9115 by pressing the horizontal portion 9117.

The distance between the vertical portion 9119 of the first connection member 9113 and the vertical portion 9119 of the second connection member 9115 is reduced by the user pressing the horizontal portion 9117. After the connection member is inserted into the insertion recess 112 of the coupling member 110 or the recess of the housing, the force applied to the horizontal portion 9117 is removed. Then, the elastic force of the elastic body 9118 causes the vertical portion 9119 of the first connection member 9113 and the vertical portion 9119 of the second connection member 9115 to be attached and fixed to the insertion recess 112 of the coupling member 110 or the recess of the housing.

As shown in FIGS. 4*a* to 4*c*, the insertion recess 112 may be formed in the middle portion of the coupling member 110 in the direction of the inner upper surface of the housing 100. The coupling recess 113 may be formed in the inside of the insertion recess 112. One ends of the first connection member 9113 and the second connection member 9115 of the light source 9000 may be coupled to the coupling recess 113.

The other ends of the first connection member 9113 and the second connection member 9115 may project outwardly from the light source body 9100. A user is able to control the interval of the connection member by pressing the projecting portions such that the light source 9000 is attached to and removed from the coupling member 110 or the housing 100.

A guide recess 9160 in which the connection member is disposed may be formed on the top surface of the light source body 9100. The connection member may move along the guide recess 9160 in a sliding manner.

The plural light source bodies 9100 may be provided. For example, as shown in FIG. 33, the light source body 9100 may include a first light source body 9130 and a second light source body 9150 disposed on the side of the first light source body 9130. The first connection member 9113 is disposed on the first light source body 9130. The second connection member 9115 is disposed on the second light source body 9150.

FIG. 35 is an exploded perspective view of a lighting device according to still another embodiment. FIG. 36 shows a process of coupling a housing with a light source body according to the still embodiment. FIG. 37 shows in detail shapes of a connection member before and after the coupling of the housing and the light source body.

Referring to FIG. 35, the lighting device according to the still another embodiment may include a housing 9500, a light source body 9600 coupled to the inner upper surface of the housing 9500, and a connection member 9700 which couples the light source body 9600 to the housing 9500. The connection member 9700 may be made of stainless steel.

The connection member 9700 may include a lower member 9710 coupled to the side of the light source body 9600, an upper member 9720 coupled to the housing 9500, and a connection portion 9730 which connects the lower member 9710 with the upper member 9720. The width of the upper member 9720 may be increased toward the top thereof to a certain height thereof.

The width of the upper member 9720 may be increased toward the top thereof. Otherwise, the width of the upper member 9720 may be increased toward the top thereof to a certain height, and then may be maintained constant or may be decreased.

A hole 9510 extending in one direction may be formed in the housing 9500. The length of the hole 9510 may be greater than the maximum width of the upper member 9720. This is because, when the length of the hole 9510 is the same as that of the upper member 9720, the connection member 9700 can be inserted into the housing 9500.

After the upper member 9720 of the connection member 9700 is inserted into the hole 9510 of the housing 9500, the upper member 9720 may be bent at a certain angle with respect to the connection portion 9730. In this case, the light source body 9600 becomes closer to the inner upper surface of the housing 9500 because the width of the upper member 9720 is increased toward the top thereof.

After the connection member 9700 having the shape shown in (A) of FIG. 37 is inserted into the housing 9500, the upper member 9720 may be bent perpendicular to the connection portion 9730 as shown in (B) of FIG. 37.

The lower member 9710 of the connection member 9700 may be screw-coupled to the side of the light source body 9600.

A light emitting module 9610 may be disposed on one side of the light source body 9600. The connection member 9700 may function as an electrical terminal of the light emitting module 9610. The connection member 9700 may be electrically connected to the light emitting module 9610. The upper member 9720 of the connection member 9700 may be electrically connected to an external power supply and provide external electric power to the light emitting module 9610.

Examples of Heat Radiating Structure Placement

As shown in FIG. 9*a*, the first body 310*a* may extend along the first axis 33 from one side to the other side thereof. Heat concentration may vary according to the position of the light emitting module 320*a* disposed on one side of the first body 310*a*.

FIG. 38 shows a heat concentration when two light source bodies are disposed on the inner upper surface of the housing. FIG. 39 shows a light source body including heat radiating fins disposed in the central portion thereof.

As shown in FIG. 38, heat generated by the use of the lighting device is concentrated on the light emitting module placed on the central portion of the light source body. Since the performance of a light emitting device, for example, an LED chip, is degraded by the heat, the performance of the light emitting module placed on the central portion of the light source body is more readily degraded than that of the light emitting module placed on the peripheral portion of the light source body.

Accordingly, there may be a light intensity difference between the central portion and peripheral portion of the lighting device. Also, light uniformity of the lighting device may be degraded.

Therefore, a light emitting module disposed on one side of the light source body 9800 shown in FIG. 39 may include a first light emitting module 9810 and a second light emitting module 9820. The first light emitting module 9810 is disposed on the central portion of one side of the light source body 9800. The second light emitting module 9820 is disposed on both sides of the first light emitting module 9810. The first light emitting module 9810 may have better optical efficiency than that of the second light emitting module 9820.

Also, a heat radiation sheet may be disposed between the first light emitting module 9810 and the light source body 9800. The heat radiation sheet may not be disposed between the second light emitting module 9820 and the light source body 9800.

In the other side of the light source body 9800, which does not include the light emitting module, a heat radiating structure 9830 may be arranged in a first area of the other side of the light source body 9800. The first area corresponds to the portion of the one side of the light source body 9800, on which the first light emitting module 9810 is disposed. The heat radiating structure 9830 may not be arranged in the rest portion other than the first area.

The heat radiating structure may be arranged not in the light source body 9800 but in a portion of the outer upper surface of the housing, which corresponds to a portion of the housing to which the light source body 9800 is coupled.

In the still another embodiment, the heat radiating structure may be arranged on the lateral sides of the light source body, which correspond to the area in which the first light emitting module is disposed.

Meanwhile, a first heat radiating structure may be arranged in the first area of the other side or lateral sides of the light source body, and a second heat radiating structure may be arranged in at least some portions of the area other than the first area. However, an arrangement density of the first heat radiating structure may be higher than that of the second heat radiating structure.

Heat is more easily radiated in the first area in which the first heat radiating structure having high arrangement density is arranged than in the area other than the first area, in which the second heat radiating structure having low arrangement density is arranged.

The first heat radiating structure and the second heat radiating structure may be a heat radiating fin or a through-hole. An interval between the heat radiating fins or through-holes of the first heat radiating structure may be less than an interval between the heat radiating fins or through-holes of the second heat radiating structure.

According to the foregoing configuration, the first light emitting module which is disposed on the central portion and generates concentratively the heat and the second emitting module which is disposed on the peripheral portion are capable of emitting light having a uniform value of the speed of light.

As described above, it will be appreciated by those skilled in the art that the present invention can be embodied in other specific forms without departing from its spirit or essential characteristics.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures. Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting device comprising:

a housing including an inner side;

a socket including a coupling portion coupled to the inner side of the housing and a receiving portion extended from the coupling portion and disposed apart from the housing;

a light source body which is coupled to the receiving portion of the socket and is electrically connected the socket; and a reflector provided in the housing, wherein the light source body is disposed apart from the housing, wherein the light source body includes a surface inclined toward the reflector, wherein the light source body includes a light emitting module comprising a substrate provided on the surface and a light emitting device arranged on the substrate, wherein the light emitting device emits lights toward the reflector, and wherein the light emitting module includes a first light emitting module which is disposed in the light source body; and a second light emitting module which is disposed adjacent to the first light emitting module, and wherein an optical efficiency of the first light emitting module is better than that of the second light emitting module.

2. The lighting device of claim 1, wherein the lighting device has a space formed between the housing and the light source body.

3. The lighting device of claim 1, wherein the light source body includes a bottom surface, and wherein the bottom surface is curved.

4. The lighting device of claim 1, further including a heat radiation sheet provided between the first light emitting module and the light source body.

5. The lighting device of claim 1, wherein the light source body further includes a heat radiating structure, wherein the heat radiating structure is disposed on the first light emitting module.

6. The lighting device of claim 1, wherein the light source body includes a first heat radiating structure and a second heat radiating structure, wherein the first heat radiating structure is arranged on the first light emitting module, wherein the second heat radiating structure is arranged on the second light emitting module, and an arrangement density of the first heat radiating structure is higher than that of the second heat radiating structure.

7. The lighting device of claim 1, wherein the socket includes a first socket coupled to a first inner side of the housing and a second socket coupled to a second inner side of the housing, wherein the light source body includes a first terminal disposed at a first side of the light source body and a second terminal disposed at a second side of the light source body, and wherein the first terminal is coupled to the first socket and the second terminal is coupled to the second socket.

8. The lighting device of claim 7, further comprising a coupler disposed on an inner bottom surface of the housing, wherein the coupler connects the first inner side with the second inner side, and wherein the first socket and the second socket are coupled to the coupler, respectively.

9. The lighting device of claim 1, wherein the socket includes a connector disposed in the receiving portion, wherein the light source body includes a terminal electrically connected to the connector of the socket, and wherein the receiving portion of the socket supports the terminal of the light source body.

10. The lighting device of claim 9, wherein the receiving portion has a shape corresponding to the shape of the terminal of the light source body, and wherein the terminal is inserted into the receiving portion.

11. The lighting device of claim 9, wherein the terminal of the light source body is disposed on both sides of the light source body respectively, and the socket is disposed on both inner sides of the housing respectively.

* * * * *